US006840596B2

(12) United States Patent
Moto et al.

(10) Patent No.: US 6,840,596 B2
(45) Date of Patent: Jan. 11, 2005

(54) INK-JET IMAGE FORMING METHOD AND INK-JET IMAGE FORMING DEVICE

(75) Inventors: Takuji Moto, Yamatokoriyama (JP); Hiroyuki Ishikura, Yamatokoriyama (JP); Susumu Hirata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/266,628

(22) Filed: Oct. 9, 2002

(65) Prior Publication Data

US 2003/0132977 A1 Jul. 17, 2003

Related U.S. Application Data

(62) Division of application No. 09/784,063, filed on Feb. 16, 2001, now Pat. No. 6,517,177.

(30) Foreign Application Priority Data

Feb. 17, 2000 (JP) ..... 2000-40241
Feb. 21, 2000 (JP) ..... 2000-43070

(51) Int. Cl.[7] ..... B41J 29/38
(52) U.S. Cl. ..... 347/14; 347/95
(58) Field of Search ..... 347/14, 16, 19, 347/43, 95, 100, 101, 102

(56) References Cited

U.S. PATENT DOCUMENTS

| | | | | |
|---|---|---|---|---|
| 4,599,627 A | | 7/1986 | Vollert | 347/20 |
| 4,682,216 A | | 7/1987 | Sasaki et al. | 358/529 |
| 5,155,503 A | | 10/1992 | Tasaki et al. | 347/14 |
| 5,428,377 A | | 6/1995 | Stoffel et al. | 347/15 |
| 5,504,506 A | | 4/1996 | Noaki | 347/16 |
| 5,568,169 A | | 10/1996 | Dudek et al. | 347/43 |
| 5,570,118 A | | 10/1996 | Rezanka et al. | 347/43 |
| 5,596,355 A | | 1/1997 | Koyama et al. | 347/43 |
| 5,614,931 A | | 3/1997 | Koike et al. | 347/43 |
| 5,617,516 A | | 4/1997 | Barton | 358/1.14 |
| 5,714,990 A | | 2/1998 | Courtney | 347/14 |
| 5,767,876 A | | 6/1998 | Koike et al. | 347/43 |
| 5,798,776 A | | 8/1998 | Uchiyama et al. | 347/43 |
| 5,921,690 A | | 7/1999 | Shinmachi et al. | 400/625 |
| 5,933,577 A | | 8/1999 | Naitoh et al. | 358/1.9 |
| 5,992,971 A | * | 11/1999 | Takahashi et al. | 347/43 |
| 6,007,194 A | | 12/1999 | Yokoyama et al. | 347/104 |
| 6,050,666 A | | 4/2000 | Yeoh et al. | 347/16 |
| 6,050,680 A | * | 4/2000 | Moriyama et al. | 347/85 |
| 6,132,021 A | | 10/2000 | Smith et al. | 347/6 |
| 6,149,327 A | * | 11/2000 | Ward et al. | 400/582 |

FOREIGN PATENT DOCUMENTS

| | | |
|---|---|---|
| EP | 0583127 A2 | 2/1994 |
| EP | 0678385 A1 | 10/1995 |
| JP | 5-38818 A | 2/1993 |
| JP | 5-147228 A | 6/1993 |
| JP | 05338136 | 12/1993 |
| JP | 5-338136 A | 12/1993 |
| JP | 6-135006 A | 5/1994 |
| JP | 06-135125 A | 5/1994 |

(List continued on next page.)

*Primary Examiner*—Lamson Nguyen
*Assistant Examiner*—Blaise Mouttet
(74) *Attorney, Agent, or Firm*—Birch, Stewart, Kolasch & Birch, LLP

(57) ABSTRACT

An ink-jet image forming method forms an image by forming dots using a fast-drying ink and a slow-drying ink, in which, when forming an image, an ambient temperature of an area where the image is formed is detected, and dot density of a predetermined area of the image is recognized based on image data. A process used to form dots is selected based on the detected ambient temperature and the recognized dot density. Under the condition where the inks are easily dried, the slow-drying ink is used to form dots, and under the condition where it is difficult to dry the inks, the slow-drying ink is used suitably with the fast-drying ink to form dots. As a result, the inks can be dried efficiently while suppressing deterioration of image quality.

11 Claims, 34 Drawing Sheets

FOREIGN PATENT DOCUMENTS

| | | | |
|---|---|---|---|
| JP | 06-136310 | A | 5/1994 |
| JP | 07-117331 | A | 5/1995 |
| JP | 07-205416 | A | 8/1995 |
| JP | 8-187880 | A | 7/1996 |
| JP | 09-076591 | A | 3/1997 |
| JP | 11-240184 | A | 9/1999 |

* cited by examiner

AREA RATIO CONVERSION TABLE

| p1 | $S_K1$ (%) |
|---|---|
| 0 | 0 |
| 1 | 11 |
| 2 | 22 |
| 3 | 33 |
| 4 | 44 |
| 5 | 55 |
| 6 | 66 |
| 7 | 77 |
| 8 | 88 |
| 9 | 99 |

| A | B | XOR |
|---|---|---|
| 0 | 0 | 0 |
| 0 | 1 | 1 |
| 1 | 0 | 1 |
| 1 | 1 | 0 |

BLACK INK TEMPERATURE CHARACTERISTICS

FIG. 16

Cad

Rad

| | Cad $2^0$ | 1 | 0 | 1 | 0 | 1 | 0 |
|---|---|---|---|---|---|---|---|
| Rad $2^0$ | row. \ col. | 1 | 2 | 3 | 4 | 5 | 6 |
| 1 | 1 | K | | K | | | |
| 0 | 2 | | K | | K | ~~K~~ | K |
| 1 | 3 | K | ~~K~~ | K | ~~K~~ | K | ~~K~~ |
| 0 | 4 | | K | ~~K~~ | K | ~~K~~ | C |
| 1 | 5 | | ~~K~~ | | ~~K~~ | K | C |
| 0 | 6 | | K | | K | ~~K~~ | C |
| 1 | 7 | Y | ~~K~~ | | C | K | C |
| 0 | 8 | Y | Y | | M | C | M |

Co · · · 50

DATA BEFORE CONVERSION

FIG. 17

Cad

Rad

| | Cad $2^0$ | 1 | 0 | 1 | 0 | 1 | 0 |
|---|---|---|---|---|---|---|---|
| Rad $2^0$ | row \ col. | 1 | 2 | 3 | 4 | 5 | 6 |
| 1 | 1 | 2/9 | | 3/9 | | | |
| 0 | 2 | | 6/9 | | 6/9 | ~~6/9~~ | 4/9 |
| 1 | 3 | 4/9 | ~~6/9~~ | 8/9 | ~~8/9~~ | 8/9 | ~~5/9~~ |
| 0 | 4 | | 6/9 | ~~8/9~~ | 8/9 | ~~7/9~~ | C |
| 1 | 5 | | ~~4/9~~ | | ~~7/9~~ | 6/9 | C |
| 0 | 6 | | 3/9 | | 5/9 | ~~5/9~~ | C |
| 1 | 7 | Y | ~~5/9~~ | | C | 3/9 | C |
| 0 | 8 | Y | Y | | M | C | M |

Co · · · 50

BLACK DOT AREA RATIO
(DATA D OF ADJACENT CELLS Co ARE ALL 0)

FIG.18

Cad

Rad

| | Cad $2^0$ | 1 | 0 | 1 | 0 | 1 | 0 |
|---|---|---|---|---|---|---|---|
| Rad $2^0$ | row. \ col. | 1 | 2 | 3 | 4 | 5 | 6 |
| 1 | 1 | K | | K | | | |
| 0 | 2 | | K | | K | YMC | K |
| 1 | 3 | K | YMC | K | YMC | K | YMC |
| 0 | 4 | | K | YMC | K | YMC | C |
| 1 | 5 | | K | | YMC | K | C |
| 0 | 6 | | K | | K | YMC | C |
| 1 | 7 | Y | YMC | | C | K | C |
| 0 | 8 | Y | Y | | M | C | M |

Co・・・ 50

DATA AFTER CONVERSION

FIG. 19

Cad

Rad

| | Cad $2^0$ | 1 | 0 | 1 | 0 | 1 | 0 |
|---|---|---|---|---|---|---|---|
| Rad $2^0$ | row. \ col. | 1 | 2 | 3 | 4 | 5 | 6 |
| 1 | 1 | 25 | | 25 | | | |
| 0 | 2 | | 50 | | 75 | 75 | 100 |
| 1 | 3 | 25 | 100 | 50 | 100 | 100 | 100 |
| 0 | 4 | | 100 | 75 | 100 | 100 | C |
| 1 | 5 | | 100 | | 100 | 100 | C |
| 0 | 6 | | 100 | | 75 | 100 | C |
| 1 | 7 | Y | 50 | | C | 100 | C |
| 0 | 8 | Y | Y | | M | C | M |

Co · · · 50

DATA BEFORE CONVERSION

FIG. 20

Cad

Rad

| | Cad $2^0$ | 1 | 0 | 1 | 0 | 1 | 0 |
|---|---|---|---|---|---|---|---|
| Rad $2^0$ | row. \ col. | 1 | 2 | 3 | 4 | 5 | 6 |
| 1 | 1 | 9 | | 18 | | | |
| 0 | 2 | | 31 | | 47 | 61 | 42 |
| 1 | 3 | 32 | 44 | 72 | 75 | 83 | 53 |
| 0 | 4 | | 58 | 81 | 81 | 78 | C |
| 1 | 5 | | 42 | | 72 | 64 | C |
| 0 | 6 | | 28 | | 53 | 53 | C |
| 1 | 7 | Y | 17 | | C | 31 | C |
| 0 | 8 | Y | Y | | M | C | M |

Co · · · 50

BLACK DOT AREA RATIO
(DATA D OF ADJACENT CELLS Co ARE ALL 0)

FIG.21

Cad

Rad

| | Cad $2^0$ | 1 | 0 | 1 | 0 | 1 | 0 |
|---|---|---|---|---|---|---|---|
| Rad $2^0$ | row \ col. | 1 | 2 | 3 | 4 | 5 | 6 |
| 1 | 1 | 25 | | 25 | | | |
| 0 | 2 | | 50 | | 75 | 50 ymc | 100 |
| 1 | 3 | 25 | 100 | 50 | 50 YMC | 50 YMC | 50 YMC |
| 0 | 4 | | 50 YMC | 50 ymc | 50 YMC | 50 YMC | C |
| 1 | 5 | | 100 | | 50 YMC | 50 YMC | C |
| 0 | 6 | | 50 ymc | | 50 ymc | 50 YMC | C |
| 1 | 7 | Y | 50 | | C | 50 YMC | C |
| 0 | 8 | Y | Y | | M | C | M |

Co

50

DATA AFTER CONVERSION

NUMBERS INDICATE DOT AREA RATIO % OF FIRST BLACK K 50 ymc INDICATES OVERLAYS OF K50% Y50% M50% AND C50%

50 YMC INDICATES OVERLAYS OF K50% Y75% M75% AND C75%

INK-JET IMAGE FORMING METHOD AND INK-JET IMAGE FORMING DEVICE

This application is a divisional continuation-in-part of application Ser. No. 09/784,063, filed on Feb. 16, 2001, now U.S. Pat. No. 6,517,177, the entire contents of which are hereby incorporated by reference and for which priority is claimed under 35 U.S.C. § 120; and this application claims priority of application No. 2000-40241 filed in Japan on Feb. 17, 2000 and 2000-43070, filed in Japan on Feb. 21, 2000 under 35 U.S.C. § 119.

FIELD OF THE INVENTION

The present invention relates to an ink-jet image forming method and an ink-jet image forming device which use a fast-drying ink and a slow-drying ink together, and in particular to an ink-jet image forming method and an ink-jet image forming device for improving image quality by increasing reproducibility of color of the slow-drying ink while maintaining a constant drying time for the slow-drying ink, e.g., a black ink. The invention also relates to improvement in preventing contamination due to contact between recording sheets after image formation when images successively formed with respect to recording sheets which are continuously fed.

BACKGROUND OF THE INVENTION

In image forming devices employing an ink-jet system (referred to as "ink-jet printer" hereinafter where appropriate), improvement in dot forming method is sought for to improve image quality and reduce drying time.

For example, U.S. Pat. No. 5,596,355 (publication date: Jan. 21, 1997) discloses a technique of forming an image with the use of a slow-drying black ink, having high black reproducibility but slow drying time, and a fast-drying black ink, which dries fast but its print density is low. In this technique, when color dots are formed adjacent to the area where black dots are formed, the fast-drying black ink is used, or inks of C, M, Y are overlaid to make up the boundary area, and the slow-drying black ink is used to form the other area.

This improves reproducibility of black and suppresses mixing of black dots and color dots at the boundary.

Further, Japanese Unexamined Patent Publication No. 149036/1995 (Tokukaihei 7-149036) (publication date: Jun. 13, 1995) discloses a technique which uses a black ink which has low permeability with respect to a recording sheet, and inks of C, M, and Y which have high permeability. FIG. 37 and FIG. 38 show an example of how dots are formed by this technique. That is, when a color dot area is formed adjacent to a black dot area, the black dots in the black dot area are interpolated and color dots are formed instead therein (staggered dots are formed). Further, it also teaches forming color dots as an underlying layer of a black dot area so that the black dots are formed over on the color dots.

This is intended to prevent mixing of the black dot area and the color dot area and to reduce a drying time of the black dots.

Further, Japanese Unexamined Patent Publication No. 197831/1996 (Tokukaihei 8-197831) (publication date: Aug. 6, 1996) discloses a technique similar to that of the foregoing publication No. 7-149036.

Further, Japanese Unexamined Patent Publication No. 338136/1993 (Tokukaihei 5-338136) (publication date: Dec. 21, 1993) discloses finding a proportion of black dots in an image to be formed and an ambient temperature of image formation, and changing a transport speed, etc., of a recording sheet with an ink based on the proportion of the black dots and the ambient temperature thus found, so as to ensure drying of the ink on the recording sheet.

Also, apart from the improvement in print method as above, there have been many proposals for reducing drying time of prints by the provision of drying means which performs heating using a halogen lamp, for example.

However, in the technique disclosed in the foregoing U.S. Pat. No. 5,596,355, the following problems are caused in forming a high black dot density area (referred to as "solid black area" hereinafter).

That is, in this technique, because the solid black area is formed with the slow-drying black ink having high reproducibility of black to improve image quality, there are cases where the prints are contaminated or black is seen through the back of the sheet due to the black ink which has not been dried sufficiently. This is due to a correlation between black dot density and drying time, whereby the drying time becomes longer in a solid black area where the black dot density is high, as in characters of 10 points or larger, or lines of 0.5 point or larger, and which exceeds a certain area.

In particular, in ink-jet printers which employ the face-down system to improve operability, the problem of sticking ink to the transport roller, which first comes into contact with the print surface immediately after the print process, and the problem of re-transfer of an ink to the recording sheet become more pronounced.

On the other hand, when the fast-drying black ink is used to form the solid black area, image quality suffers because reproducibility of black is poor.

Further, the foregoing publication No. 7-149036 and No. 8-197831 have the problem of poor image quality of black due to color dots, i.e., due to co-existing monochromatic color of yellow (Y), magenta (M), or cyan (C) in a boundary area in the black dot area.

Further, the foregoing publications do not disclose reducing drying time in a high black dot density area.

Further, according to the technique disclosed in the foregoing publication No. 5-338136, printing is made, taking into consideration black dot density and ambient temperature. However, this technique merely adjusts the drying time based on black dot density and ambient temperature, and the image forming rate may slow down depending on the image to be formed or ambient temperature. That is, this technique is not intended to actively reduce the drying time.

Therefore, this technique is bound to the problem of print contamination and see-through of black due to insufficient drying when the solid black area is formed using the slow-drying black ink to improve image quality while, at the same time, maintaining the image forming rate. Further, when these problems are to be solved by the foregoing technique, the drying time becomes longer under low-temperature conditions where ink viscosity is increased, and as a result recording speed becomes slow.

As described, the foregoing techniques of the prior art have various problems which are associated with drying of a solid black area in image formation.

On the other hand, the technique which provides the drying means has the problem of complex device structure and increased power consumption due to power consumed by the drying means.

Further, in ink-jet printers, generally, images are formed successively with respect to recording sheets which are continuously fed, and the recording sheets with images are successively discharged to a discharge tray and stacked thereon. In this case, in the event where subsequent recording sheets are discharged while the ink on the preceding recording sheet which was discharged previously has not been dried completely, there will be contamination of images due to contact between the recording sheets. In view of this problem, various proposals have been made to improve image forming operation, so that subsequent recording sheets are stacked after the ink on the preceding recording sheet is completely dried.

For example, the foregoing publication No. 5-338136 discloses a technique of calculating a black pixel ratio in an image to be formed and finding an ambient temperature of the device, and changing the transport speed of the recording sheet, which has been applied with an ink, based on the calculated black pixel ratio and the detected ambient temperature of the device, so as to ensure that the ink is dried on the recording sheet on the discharge tray before subsequent recording sheets are discharged.

Further, Japanese Unexamined Patent Publication No. 9-76591 (publication date: Mar. 25, 1997) discloses a technique of measuring the time required to dry the ink on a recording sheet which was discharged previously, and the elapsed time from the end of discharge of this recording sheet, so as to carry out intermittent transport operation of subsequent recording sheets in such a manner that the elapsed time exceeds the time required to dry the ink.

Further, Japanese Unexamined Patent Publication No. 5664/1999 (Tokukaihei 11-5664) (publication date: Jan. 12, 1999) discloses a technical idea wherein a discharge stacker is adapted to have a discharge support of plural stages, and recording sheets having been formed with images are replaced one after another in the stages of the discharge support, so as to delay the time of contact such that the recording sheets come into contact with each other after the ink has been dried.

However, in the technique disclosed in the foregoing publication No. 5-338136, while it takes into consideration black pixel ratio and ambient temperature of the device, it merely adjusts the drying time based on these variables. Thus, there were cases where the image forming rate slowed down depending on the image to be formed or ambient temperature of the device. Particularly, when the ambient temperature of the device is low, the image forming rate is decreased greatly. That is, this technique is not intended to actively reduce drying time of the ink.

Similarly, the technique disclosed in the foregoing publication No. 9-76591 is also for increasing the time required to form an image on a subsequent recording sheet, and there were cases where the image forming rate was decreased greatly depending on the image to be formed. That is, this technique is not for actively reducing drying time of the ink either.

Further, in the technique disclosed in the foregoing publication No. 11-5664, not only the structure of the discharge stacker is made complex but it requires a driving power to replace the recording sheets one after another in plural stages of the discharge support, and as a result power consumption of the entire image forming device may be increased.

As described, none of the foregoing prior art realizes stacking subsequent recording sheets after the ink on the previously discharged recording sheet is completely dried, without increasing the time required to form an image and without resulting in a complex discharge structure of the device.

Further, even though there have been proposals as above to provide drying means such as a heater to facilitate drying of the ink, this is not practical since it results in complex device structure and large power consumption by the drying means.

SUMMARY OF THE INVENTION

It is an object of the present invention to provide an ink-jet image forming method and an ink-jet image forming device which can omit or reduce the size of drying means which consumes a large amount of power and causes large increase in cost of the device, and which is capable of efficiently drying even a high dot density area while suppressing deterioration of image quality, and in particular to provide an ink-jet image forming method and an ink-jet image forming device which can create an image in a shorter period of time, and, at the same time, prevent contamination of recording sheets due to undried ink, without requiring drying means.

In order to achieve the foregoing object, an ink-jet image forming method in accordance with the present invention is adapted to form an image by forming dots using a slow-drying ink and a fast-drying ink having relatively longer drying time and shorter drying time, respectively, wherein an ink to be used to form a dot is selected from the slow-drying ink and the fast-drying ink by detecting and based on the ambient temperature of an area where the image is formed.

The ink to be used to form an image generally includes the slow-drying ink which has desirable reproducibility of color (e.g., black) but longer drying time, and the fast-drying ink which has inferior reproducibility of color but faster drying time.

The slow-drying ink has such properties that its viscosity changes depending on an ambient temperature of an area where an image is formed, and its permeation rate with respect to a recording sheet also changes depending on the ambient temperature. For example, the higher the ambient temperature, the faster the permeation rate, and the lower the ambient temperature, the slower the permeation rate.

Further, the permeation rate of the slow-drying ink has an influence on the drying time of the slow-drying ink, such that the faster the permeation rate, the shorter the drying time, and the slower the permeation rate, the longer the drying time.

Thus, the foregoing method selects an ink to be used to form dots from the slow-drying ink and the fast-drying ink based on an ambient temperature of an area where the image is formed. This allows for adjustment of an ink in accordance with temperature conditions of image formation, so as to use less slow-drying ink and use the fast-drying ink instead, thereby controlling drying time of the ink so that the ink is dried within a predetermined period of time. As a result, a print speed can be increased.

Further, the foregoing method may be adapted to adjust the use of an ink so as to use the slow-drying ink as much as possible within a range which allows the ink to dry within a predetermined period of time, thereby preventing deterioration of image quality by improving reproducibility of color.

As a result, it is possible to provide the ink-jet image forming method capable of preventing deterioration of image quality while increasing print speed.

It is preferable in the ink-jet image forming method of the present invention, in addition to the foregoing ink-jet image forming method, that dot density of an area which is defined in advance on the image with respect to the dot is recognized based on image data which is used to form the image, and the ink to be used to form the dot is selected based also on the dot density recognized.

The drying time of the dots formed with the slow-drying ink is also influenced by dot density of surrounding dots. That is, the higher the dot density, the longer the drying time, and the lower the dot density, the shorter the drying time.

Thus, the foregoing method is adapted to select an ink to be used to form dots, from the slow-drying ink and the fast-drying ink, based on dot density of dots which are formed in an area which is defined in advance with respect to dots to be formed in an image area, in addition to the ambient temperature of an area where the image is formed.

With this method, in an event where it is difficult to dry the ink, i.e., when the ambient temperature is low and the dot density is high, the dot density of the slow-drying ink can be lowered, for example, by partially using the fast-drying ink for the dots which are to be formed with the slow-drying ink, taking into consideration ambient temperature of image formation and dot density of the image to be formed As a result, drying time of the ink can be reduced and the print speed can be increased.

Further, the dot density of the fast-drying ink may be increased as much as possible within a range which can maintain a required print speed, thus preventing deterioration of image quality.

As a result, it is possible to provide the ink-jet image forming method which can increase print speed and prevent deterioration of image quality further effectively.

In order to achieve the foregoing object, an ink-jet image forming device of the present invention, which is adapted to form an image by ejecting inks, includes a slow-drying ink head for ejecting the slow-drying ink having relatively longer drying time; a fast-drying ink head for ejecting the fast-drying ink having relatively shorter drying time; a temperature detecting device for detecting ambient temperature of an area where an image is formed; and a control device for selecting an ink head which ejects an ink, from the slow-drying ink head and the fast-drying ink head, based on the detected ambient temperature.

With this arrangement, an image can be formed by driving one of or both of the slow-drying ink head and the fast-drying-ink head by the control device based on the ambient temperature of an area where the image is formed, which was detected by the temperature detecting means. Thus, it is possible with this arrangement, as with the foregoing ink-jet image forming method, to prevent deterioration of image quality while increasing print speed.

The ink-jet image forming device of the present invention preferably includes, in addition to the foregoing arrangement of the ink-jet image forming device, a calculating device which calculates density of an ink to be ejected on a predetermined area of the image based on image data used to form the image, and the control device selects an ink head which ejects an ink, from the slow-drying ink head and the fast-drying ink head, based on the calculated density of the ink.

With this arrangement, the control device can select and drive the ink head based on ink density calculated by the calculating device. Thus, with this arrangement, as above, the print speed can be increased and deterioration of image quality can be prevented further effectively.

Further, in order to achieve the foregoing object, the present invention provides an ink-jet image forming method which is adapted to use a fast-drying ink together with a slow-drying ink, and which successively forms images with the fast-drying ink and the slow-drying ink on a plurality of recording sheets which are successively fed, and discharges the recording sheets so that a subsequent recording sheet is stacked on a preceding recording sheet, wherein: a drying time which is required to dry an ink applied to each of a plurality of image forming areas on the preceding recording sheet is controlled by adjusting, with respect to each image forming area, a ratio of the fast-drying ink to the slow-drying ink which are used to form an image, so that a rest time of the ink, which is a time period from an application of the ink to a time the subsequent recording sheet is stacked, is equal to or greater than the drying time with respect to each image forming area of the preceding recording sheet.

With this method, the subsequent recording sheet is discharged after the required drying time of the ink on the preceding recording sheet has elapsed. Therefore, it is possible to prevent contamination due to contact between recording sheets after image formation, without using additional means to dry the ink.

The ink-jet image forming device of the present invention includes a rest time recognizing section and an ink ratio adjusting section, which employ the foregoing image forming method. The rest time recognizing section recognizes the rest time of an ink, which is a time period from an application of the ink to the time the subsequent recording sheet is stacked, with respect to each of a plurality of image forming areas of the preceding recording sheet. The ink ratio adjusting section controls, upon receiving an output of the rest time recognizing section, a drying time which is required to dry the ink applied to each of the plurality of image forming areas on the preceding recording sheet, by adjusting, with respect to each image forming area, a ratio of the fast-drying ink to the slow-drying ink which are used to form an image, so that the rest time of the ink is equal to or greater than the drying time with respect to each image forming area of the preceding recording sheet.

With this arrangement, the ink ratio adjusting section adjusts, with respect to each image forming area, a ratio of the fast-drying ink to the slow-drying ink which are used to form an image, so that the rest time of the ink is not less than the rest time which is required for the applied ink to dry on each image forming area. As a result, the subsequent recording sheet is discharged after the ink on the preceding recording sheet is completely dried, thereby preventing contamination of recording sheets due to contact with one another in forming images by the present device.

For a fuller understanding of the nature and advantages of the invention, reference should be made to the ensuing detailed description taken in conjunction with the accompanying drawings.

BRIEF DESCRIPTION OF THE DRAWINGS

FIG. 16 is an explanatory drawing showing data conversion in accordance with the First Embodiment in the print data area of the line memory of FIG. 14, showing data before conversion.

FIG. 17 is an explanatory drawing showing data conversion in accordance with the First Embodiment in the print data area of the line memory of FIG. 14, showing a black dot area ratio of each cell.

FIG. 18 is an explanatory drawing showing data conversion in accordance with the First Embodiment in the print data area of the line memory of FIG. 14, showing data after conversion.

FIG. 19 is an explanatory drawing showing data conversion in accordance with the Second Embodiment in the print data area of the line memory of FIG. 14, showing data before conversion.

FIG. 20 is an explanatory drawing showing data conversion in accordance with the Second Embodiment in the print data area of the line memory of FIG. 14, showing a black dot area ratio of each cell.

FIG. 21 is an explanatory drawing showing data conversion in accordance with the Second Embodiment in the print data area of the line memory of FIG. 14, showing data after conversion.

DESCRIPTION OF THE EMBODIMENTS

First Embodiment

Overall Device Structure

The following will describe one embodiment of the present invention referring to FIG. 1 through FIG. 18.

Figure 2:
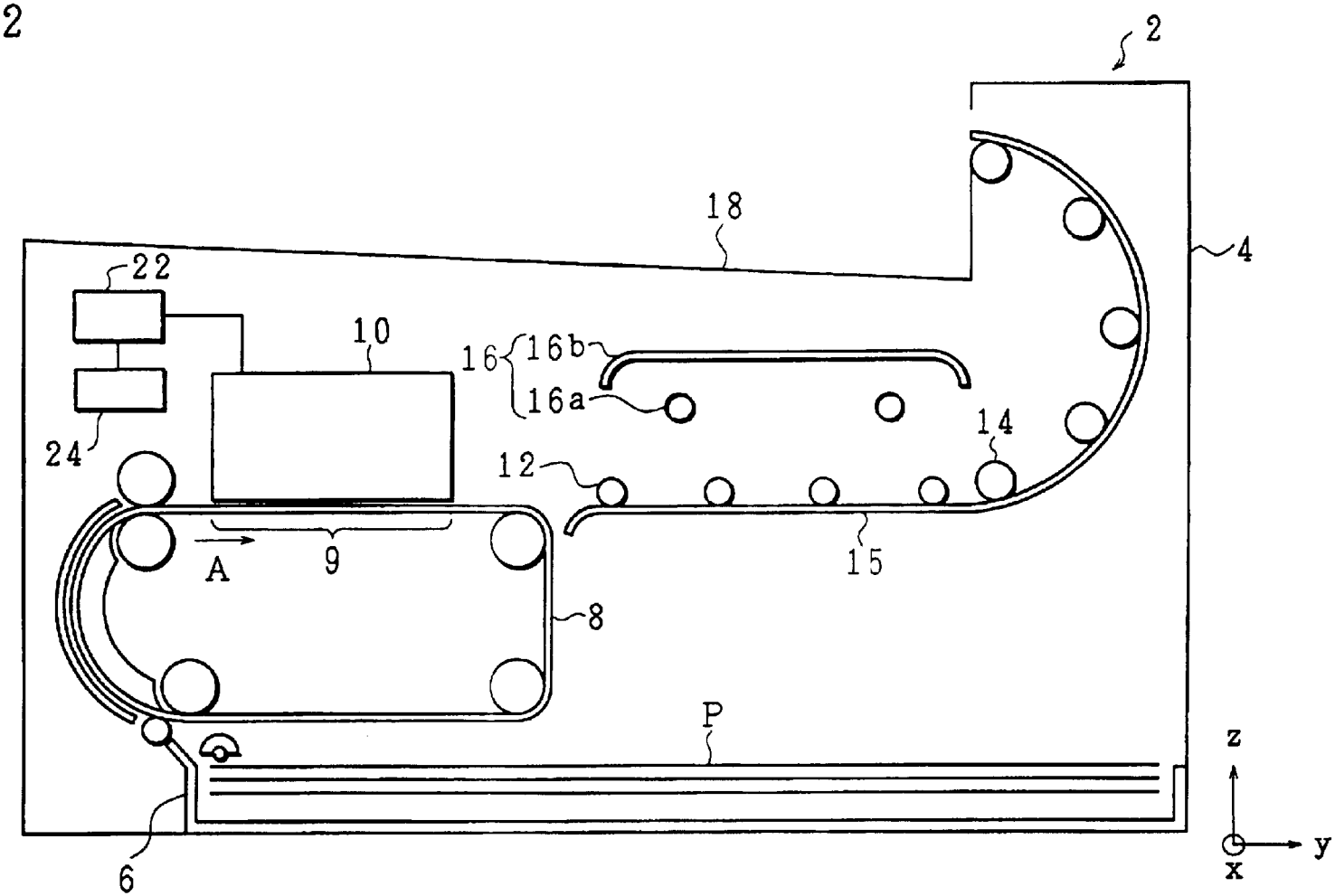
FIG. 2 is an internal view of a color ink-jet printer in accordance with First and Second Embodiments of the present invention, as viewed from the side.

First, a structure of a color ink-jet printer 2 will be described based on FIG. 2, which adopts a dot forming method employing an ink-jet system in accordance with the present embodiment. FIG. 2 shows an internal structure of the color ink-jet printer 2 in accordance with the present embodiment, as viewed from the side.

Inside a cabinet 4 of the color ink-jet printer 2 are a feeder tray 6, a transport belt 8, a head 10, star rollers 12, a transport roller 14, a transport path 15, and a drier 16. On the upper portion of the cabinet 4 is a discharge tray 18. The color ink-jet printer 2 also includes a control device (control means) 22 for controlling each element of the color ink-jet printer 2, and a temperature detecting device (temperature detecting means) 24 for detecting the temperature inside the cabinet 4 where images are formed. Note that, in the following, processes and operations of the color ink-jet printer 2 are to be controlled by the control device 22 unless otherwise noted.

When the print operation is started, a recording sheet P, which is stored in the feeder tray 6, is transported by the transport belt 8 to an image forming position 9 where the head (ink head) 10 and the transport belt 8 face each other. Then, while the recording sheet P is passing the image forming position 9, inks are ejected from the head 10 based on the position of the recording sheet P and print data (mentioned later) so as to form an image on the recording sheet P.

The recording sheet P with the inks is then transported through the transport path 15 where the star rollers 12 are disposed, and dried therethrough by the drier 16 which is disposed opposite the transport path 15. The drier 16 is composed of a halogen lamp 16*a*, and a reflecting plate 16*b* which is disposed so as to project light from the halogen lamp 16*a* onto the transport path 15, and the drier 16 is provided to heat the surface of the recording sheet P where the inks were applied, so as to facilitate drying.

The recording sheet P thus dried is discharged face-down on the discharge tray 18 outside the cabinet 4 through its traveling path by the transport roller 14 which is provided in the transport path 15.

Figure 3:
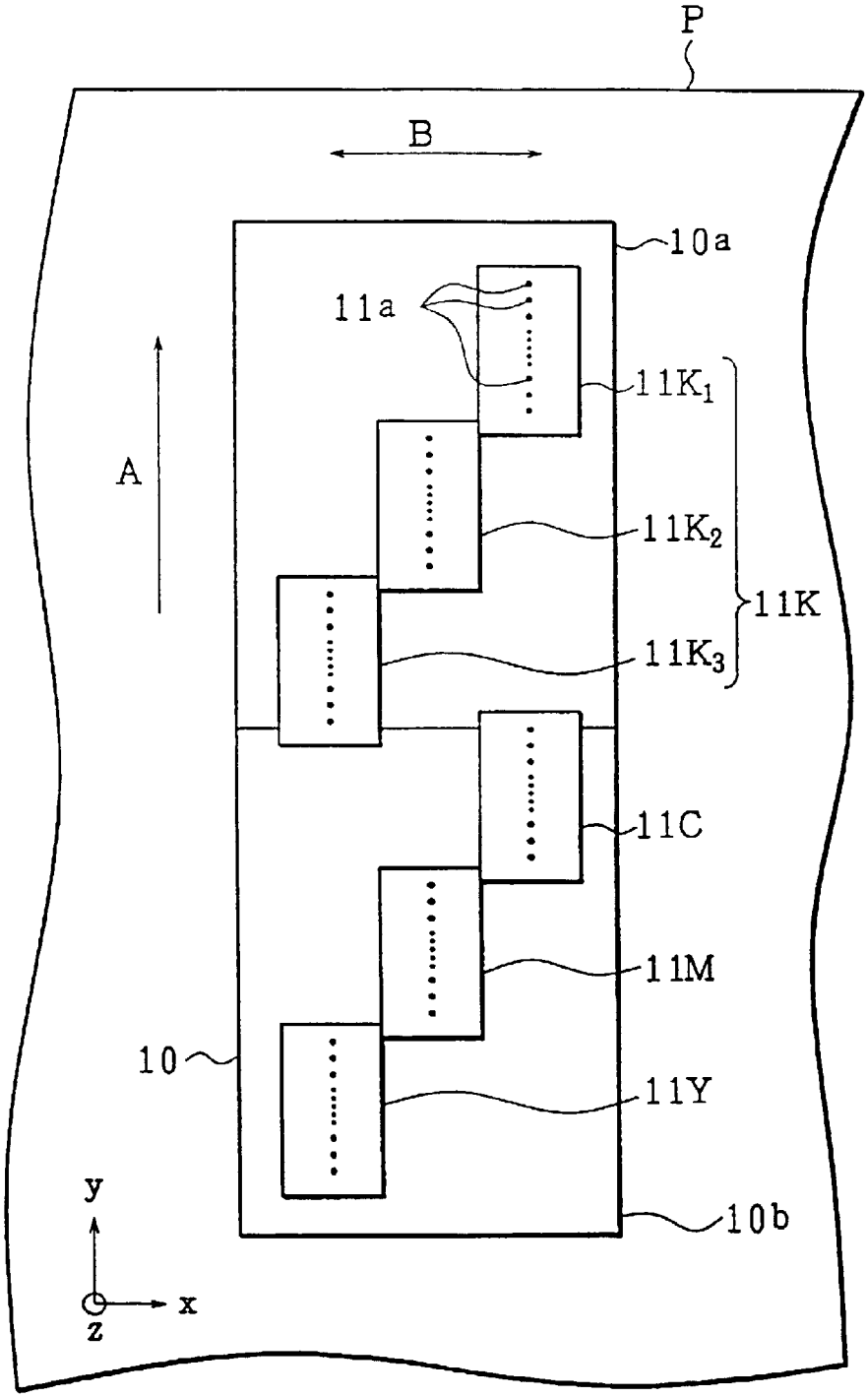
FIG. 3 is a drawing showing a disposition of nozzles when a head in FIG. 2 is viewed from above.
Figure 4:
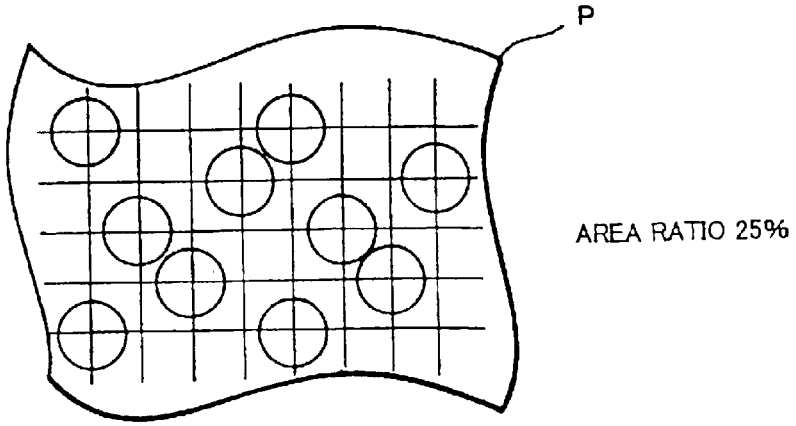
FIG. 4 is a plan view showing a disposition of dots on a recording sheet when an area ratio is 25%.

Here, directions are defined to clarify the positional relationship between an arrangement of the head 10, which will be described in the following based on FIG. 3, and a main body of the color ink-jet printer 2. As shown in FIG. 3, a direction normal to the recording sheet P on the image forming position 9 is referred to as a Z-direction, and a moving direction (direction of arrow A in FIG. 3) of the recording sheet P on the image forming position 9 is referred to as a y-direction, and a direction orthogonal to the z-direction and y-direction is referred to as an X-direction. These directions are common to FIG. 2 and FIG. 3.

Head Structure and Dots

The following will describe a structure of the head 10 based on FIG. 3. FIG. 3 shows a disposition of nozzles 11*a* when the head 10 is viewed from above (direction as viewed from the head 10 to the recording sheet P).

The head 10 is composed of a black head block (slow-drying ink ejecting means, slow-drying ink head) 10*a* and a color head block (fast-drying ink ejecting means, fast-drying ink head) 10*b*. The black head block 10*a* includes first through third black heads $\mathbf{11}K_1$ to $\mathbf{11}K_3$ which make up the black head 11K, and the color head block lob includes a cyan head 11C, a magenta head 11M, and an yellow head 11Y, corresponding to colors of cyan (C), magenta (M), and yellow (Y), respectively.

Each of the heads $\mathbf{11}K_1$ through $\mathbf{11}K_3$ and 11Y, 11M, and 11C includes, for example, 64 nozzles 11*a* for respectively ejecting their colors, and has a resolution of 600 dpi.

The amount of ink ejected, ink density, and process conditions of the blocks 10*a* and 10*b* are, for example, as shown in Table 1. The inks may have compositions, for example, as shown in Table 2.

TABLE 1

| INK TYPE | BLACK | YELLOW, MAGENTA, CYAN |
|---|---|---|
| AMOUNT OF INK EJECTED | 30 pl | 10 pl |
| DOT DIAMETER | 90 μm | 70 μm |
| PRINT DENSITY | 1.35 | 1.0 |
| PROCESS CONDITIONS | 600 DPI (PITCH OF 42.3 μm), LIQUEFYING FREQUENCY OF 12 kPPS | |

The head 10 is mounted on a driving mechanism (not shown) so that it can be oscillated in a moving direction of the head (direction of arrow B in FIG. 3) perpendicular to direction A which is the sheet transport direction. An image is formed by the ON/OFF control of ink ejection from the nozzles 11*a* by the control device 22 (see FIG. 2) based on print data (mentioned later), a position of the recording sheet P, and a position of the head 10.

Note that, here, the black ink adopts the slow-drying ink, and the color inks of yellow, magenta, and cyan adopt the fast-drying ink.

The following will describe density of dots formed (printed) on the recording sheet P by the head 10.

As the term is used herein, "dot" refers to the smallest unit of an image formed on the recording sheet P by the ejection of an ink from each nozzle 11*a*. That is, one dot corresponds to an area of an applied ink on the recording sheet P by single ejection of the ink (excluding overlaid inks) from a single nozzle 11*a*. The diameter of the dot (dot diameter) will be referred to as a dot size.

Further, "dot point" and "dot pitch" are defined as follows. The dot point is the point where the dot is formed, and the dot pitch is the distance between closest dot points.

The following describes the case where the dot points are disposed in line, and the distance between adjacent dot points in row and column directions is the same with respect to each dot point.

Print Area Ratio

It is assumed in the present embodiment that the dot size of each dot is the same (fixed dot size). Under this assumption, a print area ratio $S_O1$ (area ratio, dot area ratio) is defined by the following equation, which indicates density of dots (dot density) within a predetermined area which is made up of dot points of m rows×n columns.

$$(\text{print area ratio } S_o1)=p0/(m\times n)$$

where p0 indicates the number of dots formed in a predetermined area, i.e., the number of dots actually formed with respect to dot points in a predetermined area, and m is the number of rows of the dot points making up the predetermined area, and n in the number of columns of the dot points making up the predetermined area. Thus, the product of m and n is the number of dot points in the predetermined area. In the following, the print area ratio $S_o1$ will be represented by percent where appropriate.

Specific examples of the area ratio $S_o1$ are shown in FIG. 4 through FIG. 7. FIG. 4 through FIG. 7 are plan views which show how dots are disposed on the recording sheet P, wherein the area ratios $S_o1$ are 25%, 50%, 75%, and 100%, respectively in these drawings. That is, in FIG. 4 through FIG. 7, the dots are formed on 1/4, 1/2, 3/4, and 4/4 of the dot points, respectively.

TABLE 2

| | UNIT | BLACK | | UNIT | MAGENTA | YELLOW | CYAN |
|---|---|---|---|---|---|---|---|
| CARBON BLACK | WEIGHT % | 4 | DYE SOLUTION | WEIGHT % | 31 | 47 | 35 |
| LATEX COMPONENT | | 1 | BUTYL CARBITOL | | 12 | 12 | 12 |
| SULFOLANE | | 21 | SULFOLANE | | 15 | 15 | 10 |
| 2-PYRROLIDONE | | 7 | N-ACETYL ETHANOL | | 13 | 13 | 16 |
| WATER | | 66.5 | WATER | | 25.9 | 9.9 | 23.9 |
| CONDITIONER, ETC. | | 0.5 | CONDITIONER, ETC. | | 3.1 | 3.1 | 3.1 |
| VISCOSITY | mPa · s | 3.22 | VISCOSITY | mPa · s | 3.3 | 3.32 | 3.3 |
| SURFACE TENSION | mN/m | 44 | SURFACE TENSION | mN/m | 39 | 40 | 38.5 |
| pH | — | 8 | pH | — | 7 | 7 | 7 |

Also, in FIG. 4 through FIG. 7, the dots and dot points are represented by circles and lattice points, respectively, and the number of dot points is 40 (5 rows×8 columns=40 dot points). Further, the dot size of each dot is set to be an ideal dot size, which is given by dot pitch×√2.

In these examples, when the print area ratio $S_o1$ exceeds 50% (as in FIG. 6 and FIG. 7), adjacent dots overlap.

Here, a black dot area ratio $S_k1$ (dot area ratio), which only takes into account black dots formed with the slow-drying ink, can be defined as follows based on the foregoing print area ratio $S_o1$.

$$(\text{black dot area ratio } S_k1)=p1/(m\times n)$$

where p1 indicates the number of black dots formed in a predetermined area, i.e., the number of black dots actually formed with respect to dot points in the predetermined area.

Black Dot Area Ratio and Drying Speed

As described, when the slow-drying black ink is used to improve image quality, the drying time of the ink is increased in an area of high black dot density, i.e., in an area where the black dot area ratio $S_k1$ is high. Especially, when the black dot area ratio $S_k1$ exceeds 50% and adjacent dots overlap, the time required for drying the ink becomes particularly long.

The ink tends to permeate along the direction of paper fiber (plane direction) making up the recording sheet P more so than the direction in the thickness of the recording sheet P, and thus overlapping dots have a large influence on the drying time.

Figure 8:
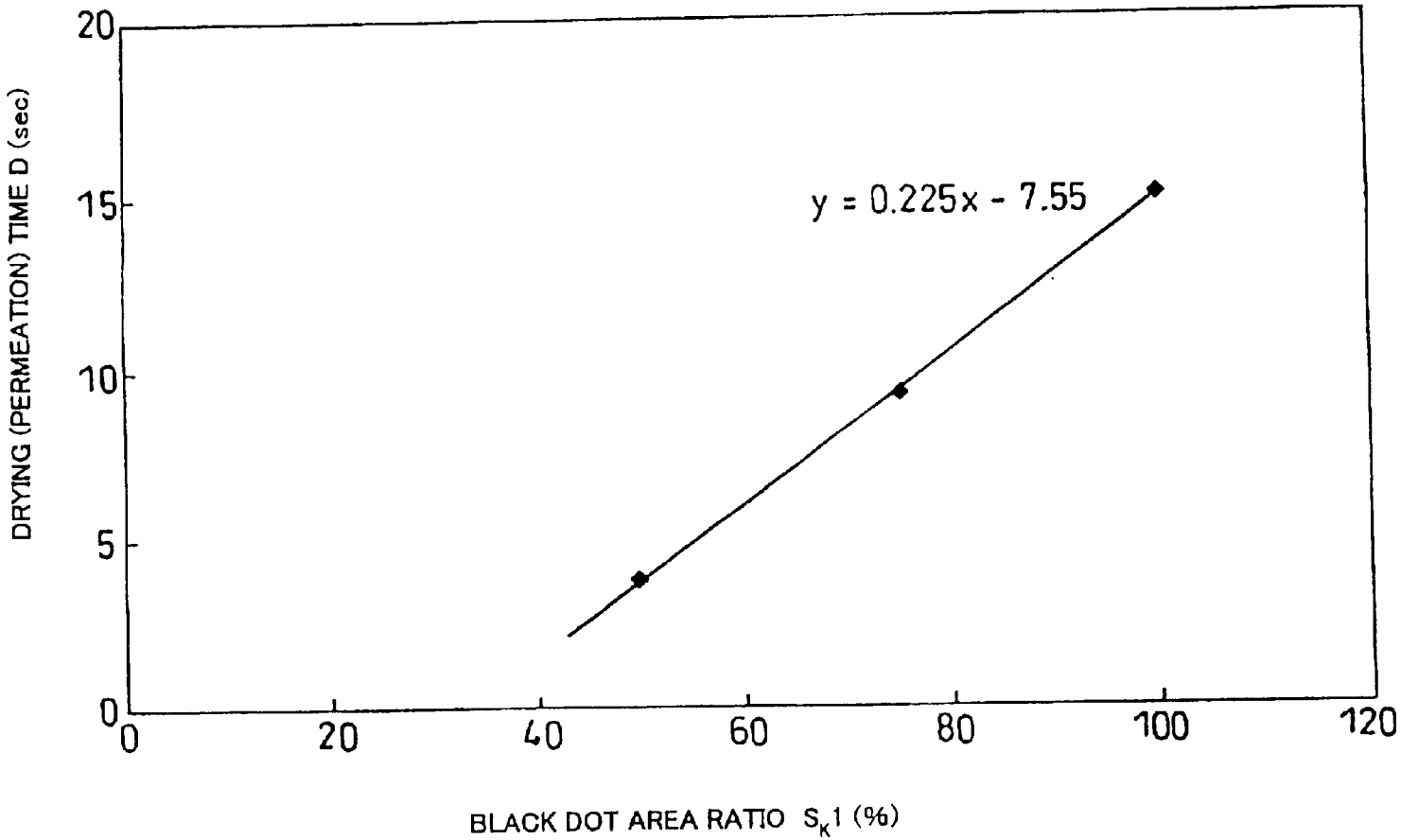
FIG. 8 is a graph showing a relationship between black dot area ratio and drying (permeation) time of a black ink.
Figure 9:
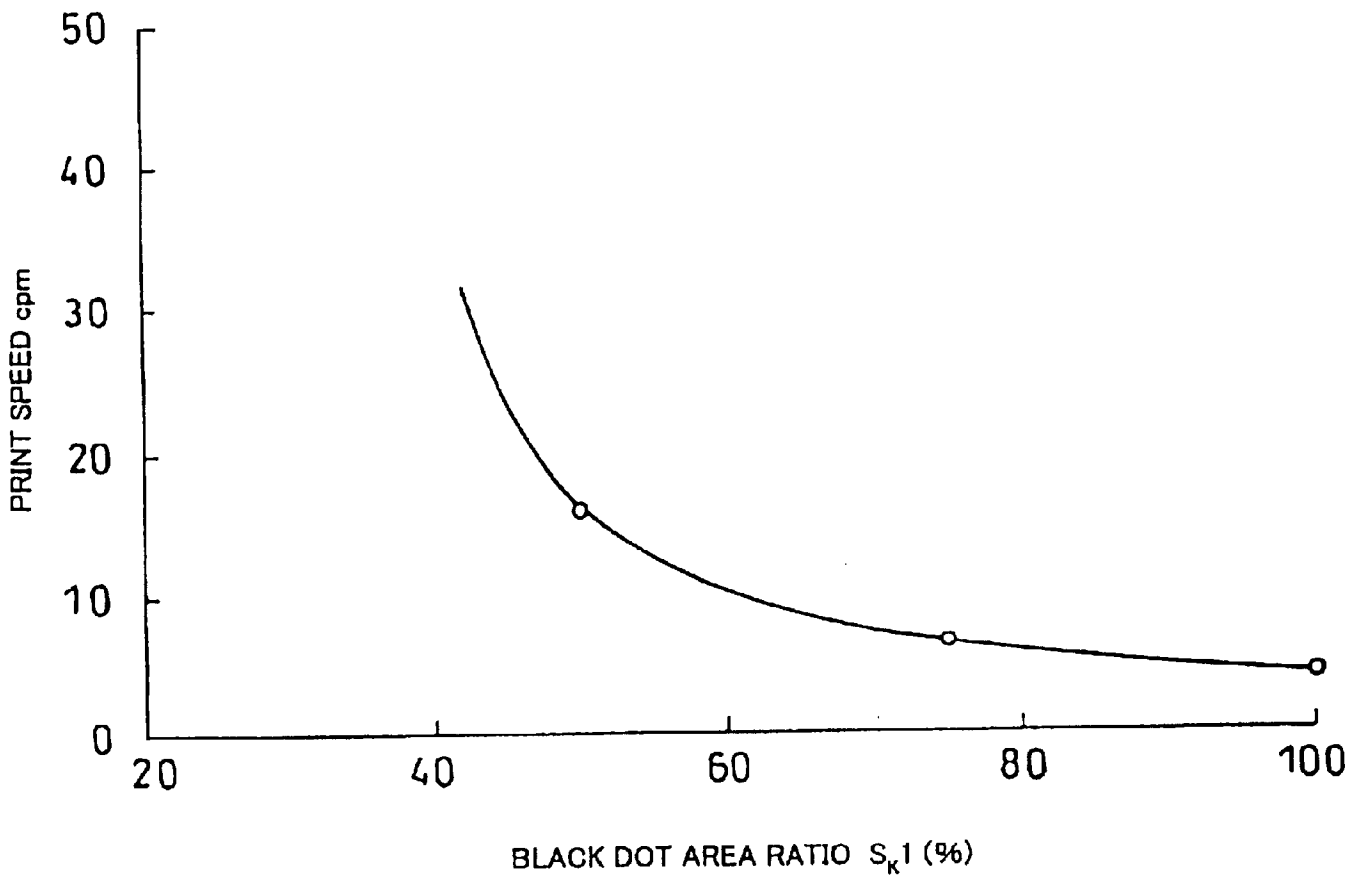
FIG. 9 is a graph showing a relationship between black dot area ratio and print speed.

This is illustrated by data in FIG. 8 and FIG. 9. FIG. 8 and FIG. 9 are graphs which show the relationship between the black dot area ratio $S_k1$ and drying (permeation) time D of the black ink in the case of FIG. 8 and a print speed (the number of prints) in the case of FIG. 9.

Figure 5:
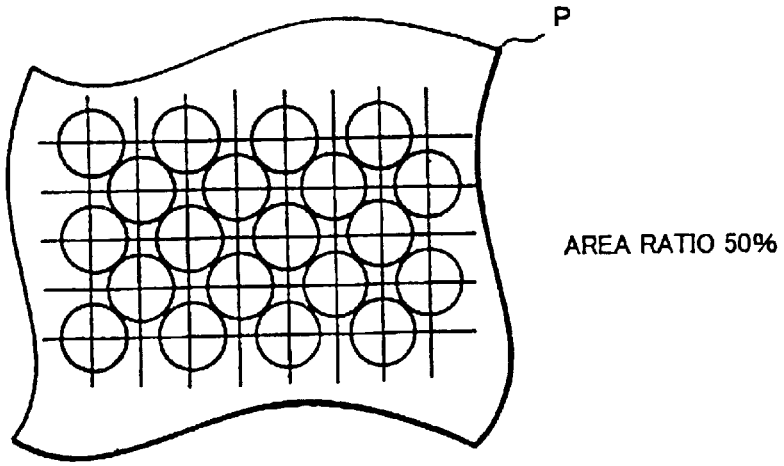
FIG. 5 is a plan view showing a disposition of dots on a recording sheet when an area ratio is 50%.
Figure 6:
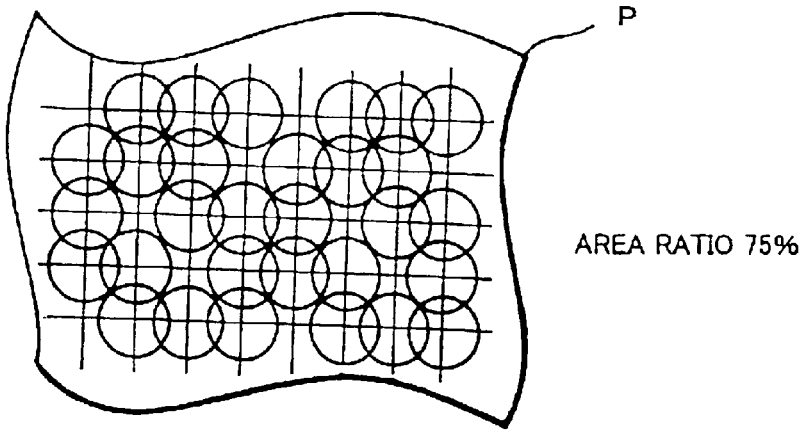
FIG. 6 is a plan view showing a disposition of dots on a recording sheet when an area ratio is 75%.
Figure 7:
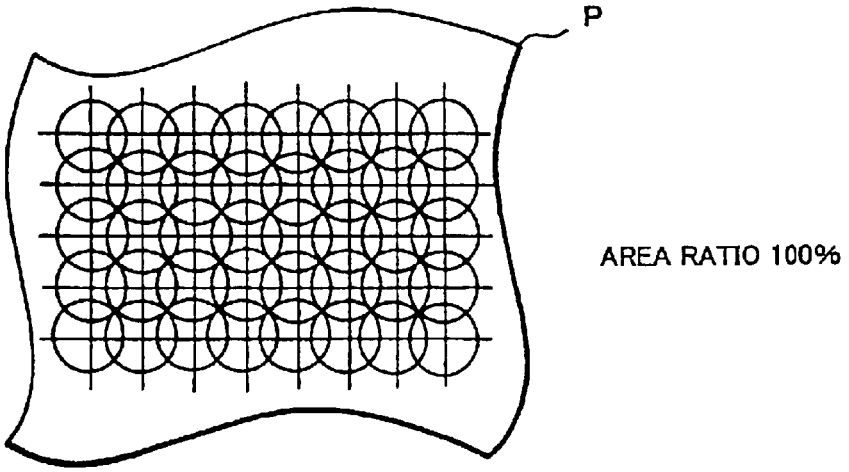
FIG. 7 is a plan view showing a disposition of dots on a recording sheet when an area ratio is 100%.

FIG. 8 shows the drying time D (measured values) which was determined by forming black dots using the slow-drying black ink in the black dot area ratios $S_k1$ on average of 50%, 75%, and 100% (as shown in FIG. 5, FIG. 6, and FIG. 7, respectively). From this result, the following relationship is established between the black dot area ratio $S_k1$ (%) and the drying time D (sec.) in a range of black dot area ratio $S_k1$ between about 40% to 100%

$$D=0.225\cdot S_k1-7.55.$$

Further, the print speed of FIG. 9 was determined by counting the number of A4-sized recording sheets P which could be printed in one minute, taking into account the drying time D of FIG. 8 (by taking an inverse of the drying time).

Ambient Temperature and Drying Rate

The following will describe a relationship between drying time D of the black ink and ambient temperature Ta. First, the relationship between ambient temperature Ta and ink viscosity η will be explained.

Figure 10:
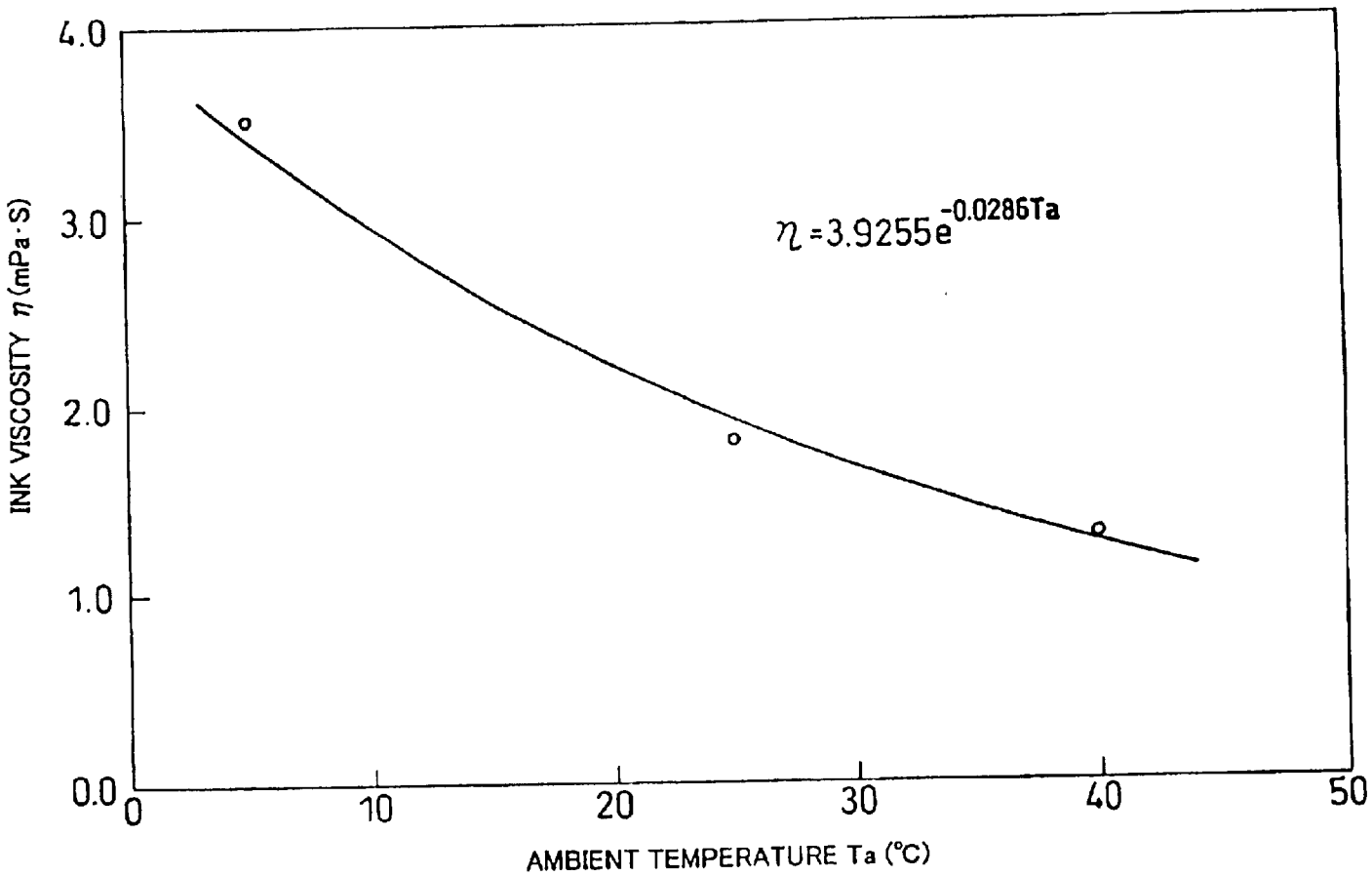
FIG. 10 is a graph showing a relationship between viscosity of a slow-drying black ink used in the embodiments of the present invention and ambient temperature.

FIG. 10 shows the result of measurement on change in ink viscosity η of the slow-drying black ink with respect to ambient temperature Ta. It can be seen from this result that the ink viscosity decreases with increase in ambient temperature Ta of the ink. Further, the relationship between ambient temperature Ta (° C.) and ink viscosity η (mPa·s) can be approximated as follows $$\eta=3.9255\cdot exp\ (-0.0286-Ta).$$

Note that, the result of FIG. 10 and the foregoing expression become different depending on the ink; however, the pattern remains essentially the same.

Here, the ink viscosity has a correlation with the permeation rate of the ink in the recording sheet when the ink is applied to the recording sheet. Specifically, the smaller the ink viscosity, the faster the permeation rate of the ink in the recording sheet, and the larger the ink viscosity, the slower the permeation rate.

Further, the permeation rate of the ink has a correlation with the drying time D of the ink. When the permeation rate of the ink is high, the ink applied to the recording sheet permeates in the recording sheet in a shorter period of time and therefore the drying time D of the ink is shorter. On the other hand, when the permeation rate of the ink is low, more ink remains on the surface of the recording sheet and the drying time D of the ink becomes longer. Therefore, in the following, descriptions which relate to the drying time D of the ink are also applicable to permeation rate of the ink.

Thus, the ambient temperature Ta has a correlation with the drying time D. That is, the higher the ambient temperature Ta, the shorter the drying time D of the ink, and the lower the ambient temperature Ta, the longer the drying time D of the ink.

Figure 11:
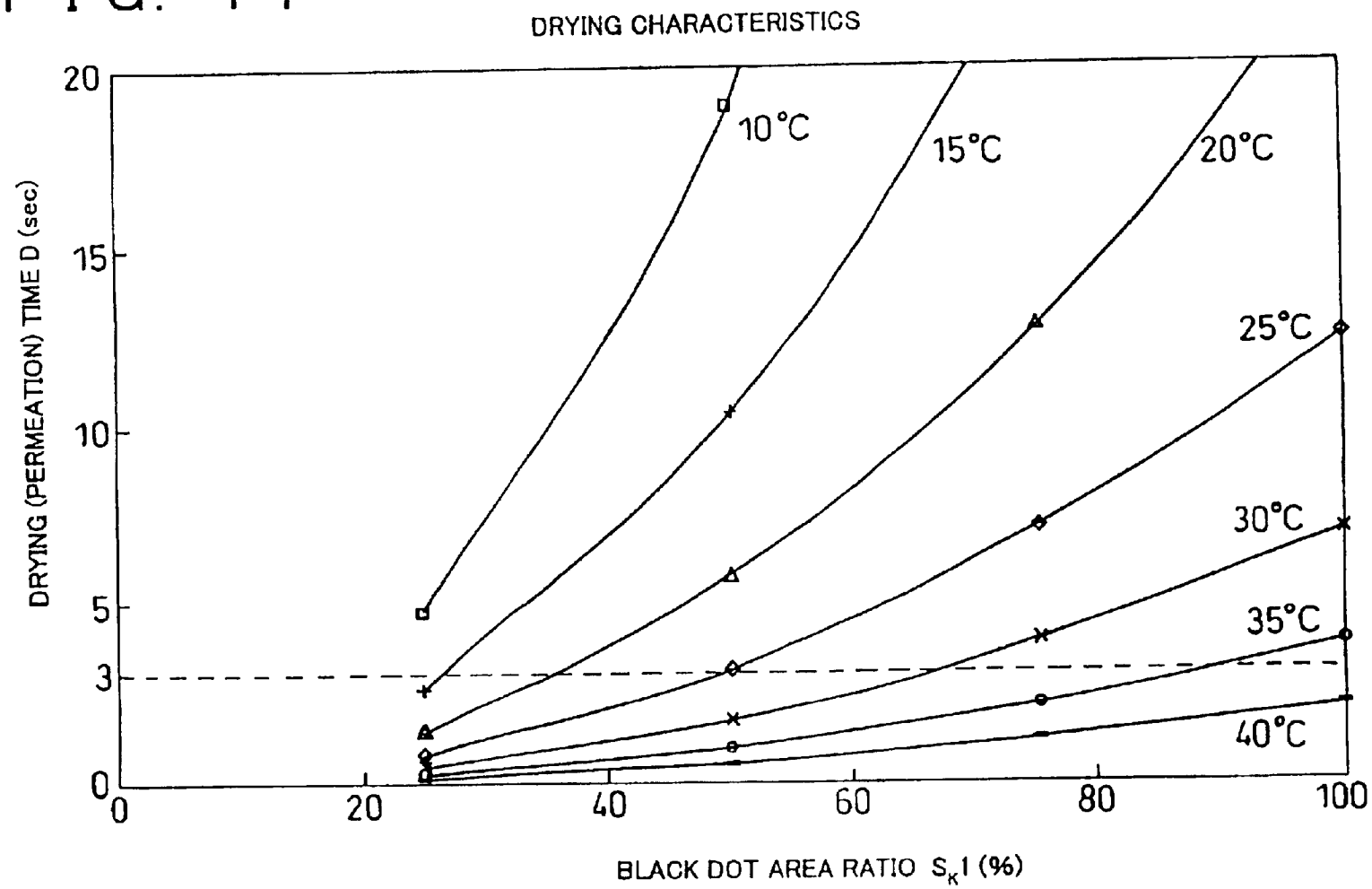
FIG. 11 is a graph showing a relationship for each ambient temperature between black dot area ratio and drying (permeation) time of the slow-drying black ink used in the embodiments of the present invention.

The following explains the relationship between the amount of ink, ambient temperature Ta, and drying time D based on FIG. 11.

FIG. 11 shows the result of measurement on drying time D when printing was made by varying the black dot area ratio $S_k1$, at the ambient temperatures Ta of 10° C., 15° C., 20° C., 25° C., 30° C., 35° C., and 40° C., using the slow-drying black ink.

Here, the upper limit of the drying time D is set to 3 seconds (as indicated by the broken line in FIG. 11). From the temperature characteristics of the slow-drying black ink as shown in FIG. 11, the acceptable limit of the black dot area ratio $S_k1$ for each ambient temperature Ta can be determined. The acceptable limit of the black dot area ratio $S_k1$ is given by the point where the curve indicating each ambient temperature Ta intersects the broken line in FIG. 11. The acceptable limit of the black dot area ratio $S_k1$ will be referred to as a maximum black dot area ratio (maximum dot density) Bmax.

Figure 12:
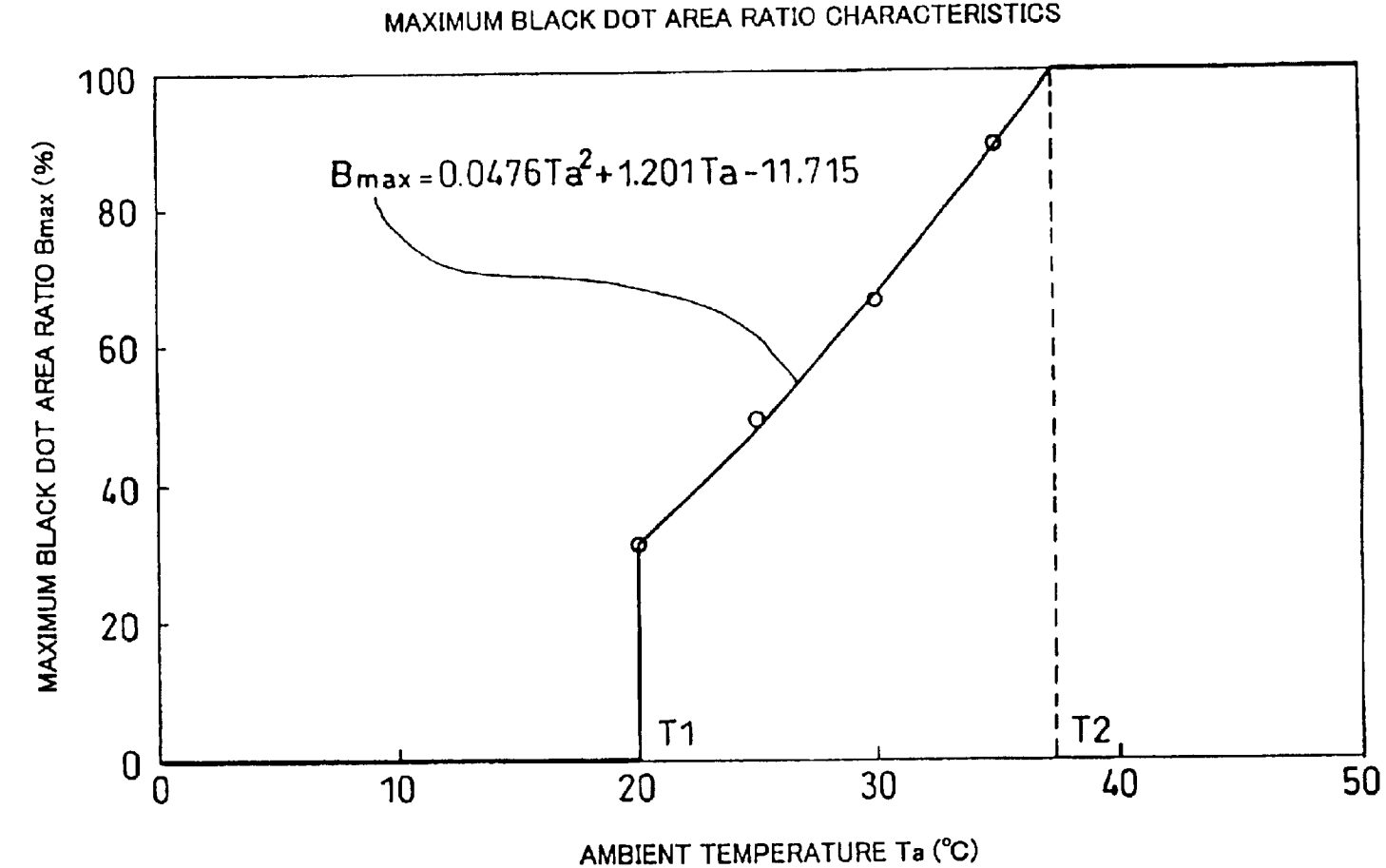
FIG. 12 is a graph showing a relationship between ambient temperature and maximum black dot area ratio which was set based on FIG. 11.

The relationship between the maximum black dot area ratio Bmax and the ambient temperature Ta is plotted as shown by the graph of FIG. 12. FIG. 12 thus is the graph which shows the relationship between the ambient temperature Ta and the maximum black dot area ratio Bmax.

Here, in actual image formation, when the black dot area ratio is 30% or less, the black dots are isolated from one another. Therefore, it is difficult to appropriately control the black dot area ratio $S_k1$ when the black dot area ratio $S_k1$ is 30% or less.

Thus, the ambient temperature Ta at which the maximum black dot area ratio Bmax becomes 30% is given as a first temperature T1 (° C.), and it is deemed that the maximum black dot area ratio Bmax is 0% in a range where the ambient temperature Ta is not more than the first temperature T1. Note that, the first temperature T1 is not just limited to the value of 30% and is determined by the ink used or arrangement of the device.

Also, the ambient temperature Ta at which the maximum black dot area ratio Bmax is 100%, i.e., at which the black dot area ratio $S_k1$ takes its maximum value is given as a second temperature T2 (° C.).

Then, a function of an approximate curve given by each measured point is determined within a range of ambient temperature Ta between not less than the first temperature Ta and not more than the second temperature T2. Here, the relationship between the ambient temperature Ta (° C.) and the maximum black dot area ratio Bmax (%) can be approximated by the following equation (1)

$$Bmax=0.0476\cdot Ta^2+1.201\cdot Ta-11.715 \quad (1).$$

Note that, here, even though the approximation by the second order function ($Bmax=\alpha Ta^2+\beta Ta-C$) is shown by equation (1), approximation can also be given by the first order function ($Bmax=\alpha Ta-C$) of the following equation (2), i.e., linear approximation, which is accurate enough for practical applications $$Bmax=3.78\cdot Ta-44.9 \quad (2).$$

In this manner, it is preferable to set a function which equates the ambient temperature Ta and the maximum black dot area ratio Bmax, and to determine a black dot area ratio Bmax which corresponds to the ambient temperature Ta using this function. In this way, a suitable maximum black dot area ratio Bmax can be obtained with respect to an arbitrary ambient temperature Ta.

Here, when the ambient temperature Ta is not less than the second temperature T2, the drying time D can be prevented from exceeding above the upper limit of the drying time D even when all black dots are formed with the slow-drying black ink, irrespective of the black dot area ratio $S_k1$. Thus, when the ambient temperature Ta is not less than the second temperature T2, all black dots are formed with the slow-drying black ink.

As a result, the head for the slow-drying black ink can be efficiently used, and the fast-drying black ink, which may be used instead of the slow-drying black ink as will be described later, can be saved.

Further, when the ambient temperature is not more than the first temperature T1, the maximum black dot area ratio Bmax is 0%, and thus, by forming the black dots using the slow-drying black ink together with the fast-drying black ink as will be described later, the drying time can be made shorter.

On the other hand, when the ambient temperature Ta exceeds the first temperature Ta and below the second temperature T2, the maximum black dot area ratio Bmax of a given ambient temperature Ta in this range is determined based on the foregoing approximate expressions (equation (1) or (2)), and the resulting value is compared with the black dot area ratio $S_k1$ to be actually printed. When $Bmax<S_k1$, all black dots which correspond to the black dot area ratio $S_k1$ to be actually printed are formed using the slow-drying black ink, and when $Bmax<S_k1$, the black dots are formed using the slow-drying black ink and the fast-drying black ink so as to shorten the drying time (details will be described later).

Note that, the ambient temperature Ta is detected by the temperature detecting device 24, and the calculation is performed by the control device 22 (see FIG. 2). Also, the first temperature, second temperature, and approximate expressions (equation (1) or (2)) are determined in advance for each ink to be used and are stored in the control device 22.

Print Data

The following will describe print data (image information, image data) for forming dot images.

Figure 13:
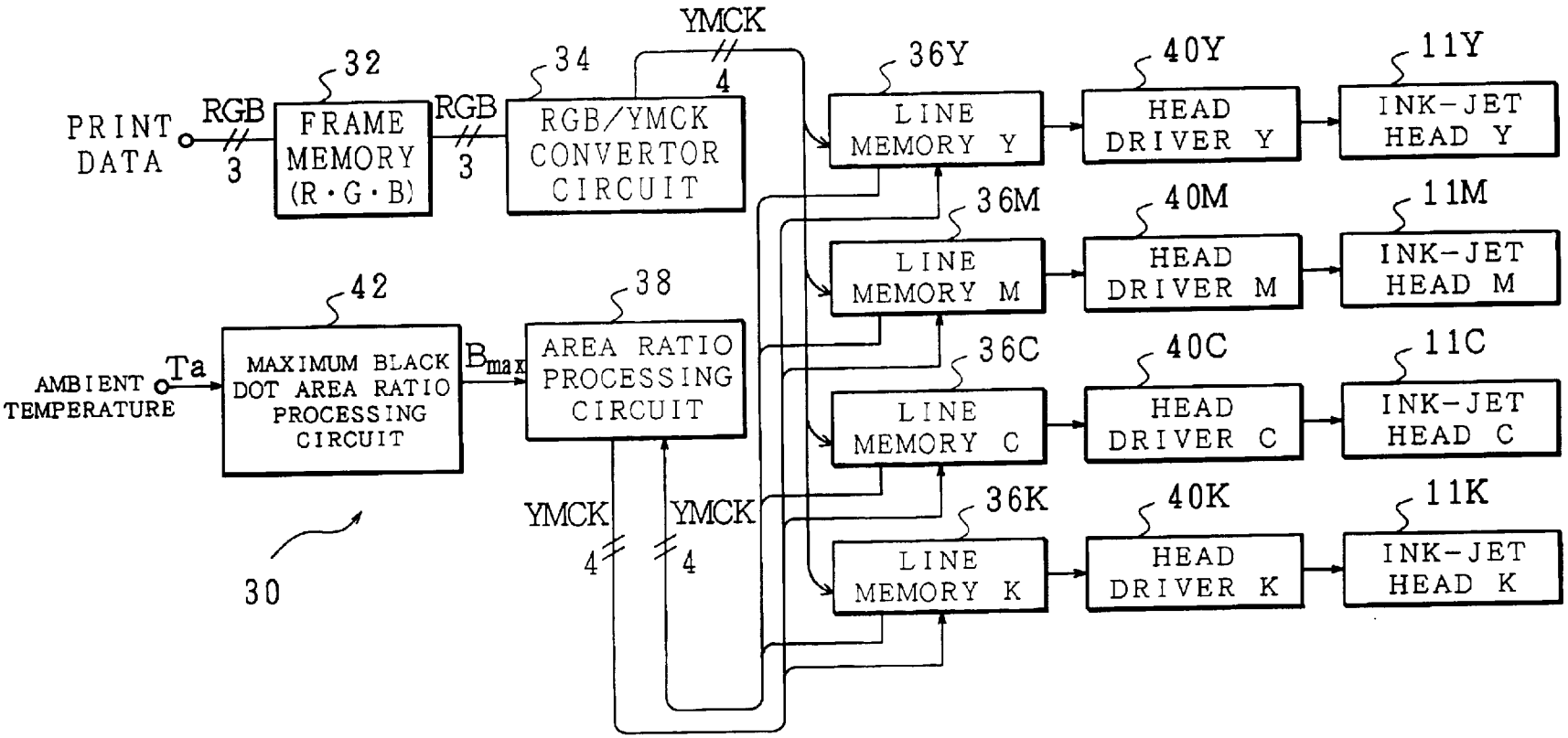
FIG. 13 is a block diagram showing a data processing circuit of print data in accordance with the First and Second Embodiments of the present invention.

First, a flow of print data is explained based on FIG. 13. FIG. 13 is a block diagram showing a data processing circuit 30 of the print data. The data processing circuit 30 is provided, for example, in the control device 22. Note that, in FIG. 13, R, G, B, and Y, M, C, K indicate print data (color data) of red, green, blue, and yellow, magenta, cyan, black, respectively. Also, in the lines connecting blocks, the numbers such as "3" and "4" together with the symbol "//" indicate the number of data of the line (the number of data lines).

The print data of RGB are converted to print data of YMCK in an RGB/YMCK convertor circuit 34 via a frame memory 32. The converted data are then inputted to their respective line memories 36Y, 36M, 36C, and 36K. Note that, when the original print data is the print data of YMCK, the RGB/YMCK convertor circuit 34 is not necessary.

The respective data inputted to the lines memories 36Y, 36M, 36C, and 36K are successively sent to an area ratio processing circuit (calculation means, data converting section) 38, and the black dot area ratio $S_k1$ is calculated. The black dot area ratio $S_k1$ is used therein to decide whether to perform data conversion.

That is, the area ratio processing circuit 38 acts both as the calculation means for calculating the black dot area ratio $S_k1$ and as judging means for performing whether to perform data conversion based on the black dot area ratio $S_k1$ and the maximum black dot area ratio Bmax.

Thus, to the area ratio processing circuit 38 is also sent a value of the maximum black dot area ratio Bmax which is based on the ambient temperature Ta of image formation.

The value of the maximum black dot area ratio Bmax is calculated by a maximum black dot area ratio processing circuit (maximum dot density output section) 42 and sent to the area ratio processing circuit 38. The maximum black dot area ratio processing circuit 42 receives data of ambient temperature Ta as detected by the temperature detecting device 24 (see FIG. 2), and calculates the maximum black dot area ratio Bmax based on the first and second temperatures T1 and T2 and the approximate expression (equation (1) ○ (2)), which are pre-stored.

Note that, the maximum black dot area ratio Bmax may be calculated by the provision of a look-up table in the maximum black dot area ratio processing circuit 42, and by referring to the look-up table according to the ambient temperature Ta.

Then, by the presence or absence of the data conversion, the ink to be used to form dots is decided. Note that, details of calculation of black dot area ratio $S_k1$, whether to perform data conversion, and data conversion will be described later.

The data of respective colors used in the calculation are inputted again into their respective line memories 36Y, 36M, 36C, and 36K. The data of respective colors thus inputted again to the line memories 36Y, 36M, 36C, and 36K from the area ratio processing circuit 38 are inputted to their corresponding head drivers 40Y, 40M, 40C, and 40K. The head drivers 40Y, 40M, 40C, and 40K drive their corresponding yellow head 11Y, magenta head 11M, cyan head 11C, and black head 11K based on the respective inputted print data. The yellow head 11Y, magenta head 11M, cyan head 11C, and black head 11K then form dots on the recording sheet P (see FIG. 3).

Memory (Line Memory) Structure

Figure 14:
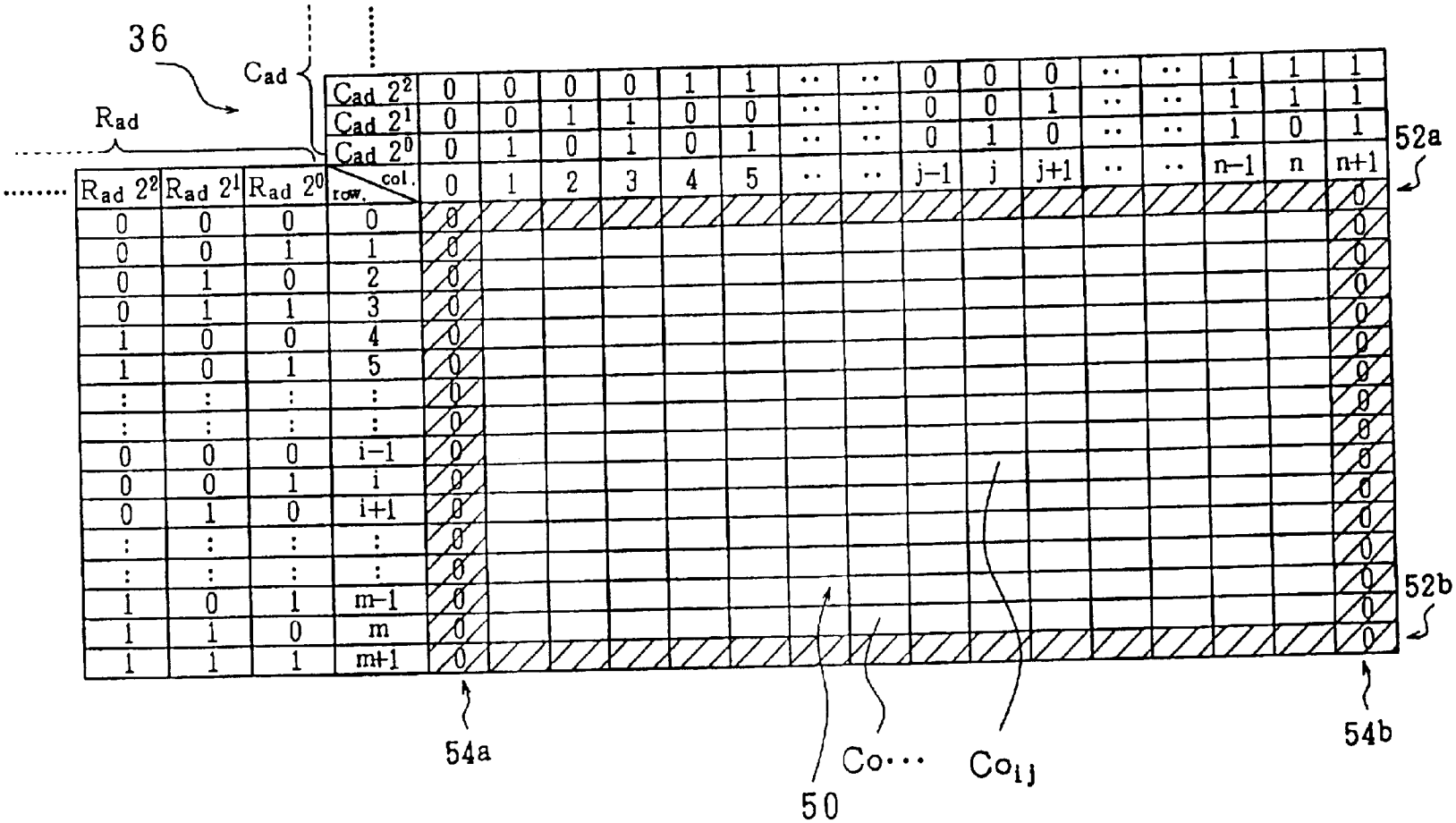
FIG. 14 is an explanatory drawing showing a memory structure of a line memory in accordance with the embodiments of the present invention.

The following will describe the line memories 36Y, 36M, 36C, and 36K based on FIG. 14.

FIG. 14 is an explanatory drawing showing a memory structure of the line memory 36. Note that, the line memories 36Y, 36M, 36C, and 36K have the same memory structure, and, for convenience of explanation, they will be collectively referred to simply as the line memory 36 in the following explanation. That is, cells which have the same address (described later) in each of the line memories 36Y, 36M, 36C, and 36K will be regarded as a cell Co, and cells Co store data of their respective colors.

The line memory 36 is made up of a print data area (record image area) 50, first and second correction data areas 52*a* and 52*b*, first and second dummy data areas 54*a* and 54*b*, and an address allocated to each row and column of each area.

The print data area 50 is composed of a memory map which is made up of cells Co of m rows×n columns for storing a portion of print data. The cells Co making up the print data area 50 correspond to the dot points one to one, and each cell Co stores data D, which is the information of dot to be formed on each dot point.

The data D has the value of either 1 or 0, depending on whether a dot is to be formed or not, respectively. Specifically, data $D_{ij}$, which is stored in a cell $Co_{ij}$ at the ith row and jth column, comes to have the value $D_{ij}=1$ when a dot is to be formed on a dot point corresponding to the cell $Co_{ij}$, and the value of $D_{ij}=0$ when a dot is not to be formed on the dot point corresponding to the cell $Co_{ij}$.

Note that, the subscript "ij" indicates ith row and ith column, which will be given only when specifying a position on the rows and columns in particular. Also, "data D" will be referred to when explaining data in general where colors of data are not distinguished, and the data D will be represented by data Y, data M, data C, and data K when their colors are distinguished.

Here, the row direction and column direction in the print data area 50 correspond to a main scanning direction (head moving direction, direction B in FIG. 3) and a sub scanning direction (sheet transport direction, Direction A in FIG. 3) of the head 10, respectively.

Further, the print data area 50 is arranged to sequentially store print data by dividing the print data in the sub scanning direction. That is, the cells Co of a single row in the print data area 50 can store all the data D in each row of the main scanning direction (width direction of the recording sheet (see FIG. 3)), and the cells Co of a single column in the print data area 50 can store data D in each column divided in the sub-scanning direction.

Further, to the cells Co of m rows×n columns in the print data area 50 are given row numbers (channel, row) of 1 to m from the first row to the last row, and column numbers (col.) of 1 to n from the first column to the last column.

The first and second correction data areas 52*a* and 52*b* and the first and second dummy data areas 54*a* and 54*b* are data areas which correspond to a peripheral portion of a portion on the actual print image corresponding to the print data area. These data areas store data D, in the outermost periphery of the print data area 50, which is used to calculate the black dot area ratio $S_k1$ in the manner described below.

The first and second correction data areas 52*a* and 52*b* are made up of cells Co of rows immediately before the first row (upper side in FIG. 14) and immediately after the last row (lower side in FIG. 14) of the print data area 50, respectively, and are given the row numbers 0 and m+1, respectively. The first data correction area 52*a* stores data (channel 1 correction data) which was stored previously in the row=m of the print data area 50, and the second data correction area 52*b* stores data (channel m correction data) which will be stored next in the row=1 of the print data area 50.

Also, the first and second dummy data areas 54*a* and 54*b* are made up of cells Co of columns immediately before the first column (left side in FIG. 14) and immediately after the last column (right side in FIG. 14) of the print data area 50, respectively, and are given the column numbers 0 and n+1, respectively. The first and second dummy data areas 54*a* and 54*b* correspond to areas on the both sides of the recording sheet P (areas where no print data exist, margin) where no image is formed, and thus all cells Co of these data areas store data D=0.

To each of the rows and columns making up the foregoing areas are given address Rad and address Cad, respectively. The address Rad and address Cad represent the row number and the column number, respectively, in binary digits. Note that, for convenience of explanation, the address Rad and address Cad will be represented by addresses $Rad2^0$, $Rad2^1$, . . . , and addresses $Cad2^0$, $Cad2^1$, . . . , respectively, successively from the lower bits (first digit, second digit . . . ).

Conversion of Print Data

The following will describe data conversion of print data on the line memory 36 by the area ratio processing circuit 38 (see FIG. 13), with reference to FIG. 15 through FIG. 18. First, the case of ambient temperature Ta in a range of T1<Ta<T2 will be explained.

As described, when the black dots of an area where the black dot area ratio $S_k1$ exceeds the maximum black dot area ratio Bmax are formed using the slow-drying black ink (slow-drying ink), the drying time D of the ink exceeds the pre-set upper limit. Thus, in an area where the black dot area ratio $S_k1$ exceeds the maximum black dot area ratio Bmax, the fast-drying black ink (fast-drying ink) is partially used. In the following, the black dots which are formed by the slow-drying black ink will be referred to as first black dots, and the black dots which are formed by the fast-drying black ink will be referred to as second black dots.

The foregoing defined the black dot area ratio $S_k1$ as the value which indicates the degree of black dot density (degree of solid black) when the black dots are assumed to be uniformly formed in a predetermined area which is made up of dot points of m rows×n columns (see FIG. 4 through FIG. 7). In the actual print image, the black dot density becomes different depending on different parts of the image, and thus the black dot area ratio $S_k1$ is set in the following manner.

Looking at a certain dot point, when this dot point ("target point" hereinafter) has the black dot, the ink drying time D of the black dot depends on how many black dots are present in an area surrounding (adjacent to) the target point. Thus, the black dot area ratio $S_k1$ of the target point is defined as the black dot area ratio $S_k1$ of an area of 3 rows×3 columns surrounding the target point on center (target dot area, image area).

Figure 15:
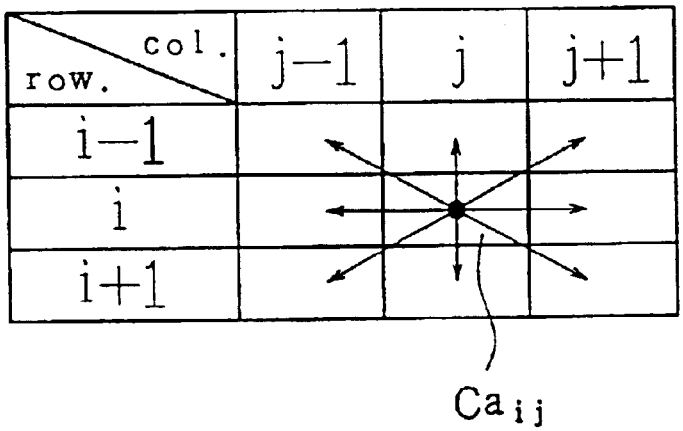
FIG. 15 is an explanatory drawing showing a portion of a print data area of the line memory of FIG. 14, corresponding to a target pixel.

The following explains how the black dot area ratio $S_k1$ of the target point thus set is determined, with reference to FIG. 15. FIG. 15 is an explanatory drawing which shows a portion (target cell area) corresponding to a target dot area in the print data area 50 (see FIG. 14) of the line memory 36. Here, since the dot points correspond to the cells Co one to one, in the following, the cell which corresponds to the target point will be referred to as a target cell Ca, and an area of cells Co which corresponds to the dot points making up the target dot area will be referred to as a target cell area.

As shown in FIG. 15, when a cell $Co_{ij}$ is a target cell $Ca_{ij}$, cells Co which belong to rows (i−1), i, (i+1), and columns (j−1), j, (j+1) make up the target cell area. Thus, it can be said that the target cell area is a filter of 3 rows×3 columns in the print data area 50.

With regard to the black dot, the target cell $Ca_{ij}$ only has data $K_{ij}$ of 0 or 1, which indicates whether to form the black dot or not, and thus to determine the black dot area ratio $S_k1$, data D of the target cell area is required. That is, the black dot area ratio $S_k1$ can be determined by counting the number of cells Co in which data K of the black dot is 1 among 9 cells Co of the 3 rows×3 columns making up the target cell area, and by dividing the counted number by nine. Note that, in the following, data K of the black dot which is not 0 will be referred to as black data.

Specifically, when the number of cells having the black data is X in the cells Co of the target cell area with respect to the target cell $Ca_{ij}$, the black dot area ratio $S_k1$ of the target cell $Ca_{ij}$ becomes X/9.

The following will explain how black dots are formed based on the black dot area ratio $S_k1$ thus determined, with reference to FIG. 16 through FIG. 18. FIG. 16 through FIG. 18 are explanatory drawings which show data conversion in the print data area 50 of the line memory 36, in which FIG. 16 shows data D before conversion, FIG. 17 shows the black dot area ratio $S_k1$ of each cell Co, and FIG. 18 shows data D after conversion.

Note that, in FIG. 16 through FIG. 18, when data Y, data M, data C, and data K are "1", they are indicated by "Y", "M", "C", and "K", respectively, and they are not indicated when "0". Also, data D of cells Co adjacent to the area shown in the drawings are assumed to be "0". Further, the following explanation is based on the case where the ambient temperature Ta is about 25° C., i.e., the case where the maximum black dot area ratio Bmax=50% (see FIG. 12).

First, the black dot area ratio $S_k1$ of each cell Co having the black data in the print data area 50 of FIG. 16 with data D is successively determined. As a result, each cell Co comes to have a black dot area ratio $S_k1$ as shown in FIG. 17. Note that, the black dot area ratio $S_k1$ is not necessarily stored in each cell Co, but, for convenience of explanation, FIG. 17 shows the black dot area ratio $S_k1$ corresponding to each cell Co.

As described, when the black dot area ratio $S_k1$ exceeds the maximum black dot area ratio Bmax (here, 50%) (i.e., 5/9 or above), the drying time D of the ink exceeds its pre-set upper limit. Thus, the black dot area ratio $S_k1$ exceeding the maximum black dot area ratio Bmax is given as a condition (first condition) of conversion (data conversion) using the second black dot instead of the first black dot with respect to data D of the cells Co.

Here, among cells Co having the black dot area ratios $S_k1$ which exceed the maximum black dot area ratio Bmax, i.e., cells Co satisfying the first condition (high density dot group), the cells Co to be actually subjected to data conversion using the second black dot are preferably determined based on their positions.

Specifically, it is preferable that the cells Co to be subjected to data conversion are arranged alternately in the row direction and column direction. To realize this, cells Co of address Rad2° and address Cad2°, which are the lowest bits of the row address and the column address, respectively, whose exclusive OR is "1" are taken as the cells Co to be subjected to data conversion (second condition). In FIG. 16 through FIG. 18, cells Co having data K of black dot before conversion, and whose exclusive OR is "1" are indicated by the oblique lines.

Thus, when the cells Co whose black dot area ratios $S_k1$ exceed the maximum black dot area ratio Bmax are adjacent to one another in the row and column directions, there will be an alternate disposition of cells Co having data K for forming the first black dot ("first black data" hereinafter) and cells Co having data K for forming the second dot ("second black data" hereinafter).

Further, with regard to cells Co having black data at the boundary (boundary portion) with the color area (area where any of data Y, M, C is not "0"), in order to prevent mixing of black dots with the color area, it is preferable to carry out data conversion when the second condition is met, even when the black dot area ratio $S_k1$ is not larger than the maximum black dot area ratio Bmax. The cells co having black data at the boundary with the color area are given as cells Co to be subjected to data conversion (third condition).

Note that, here, the second dots are formed by overlaying the inks (color inks) of Y, M, and C. Therefore, the values stored in the cells Co which were converted to have the second black data all become "1" with respect to the data Y, M, and C, and "0" with respect to data K. Table 3 shows correspondence of data conversion between data D before conversion and data D after conversion. Also, the results of data conversion are shown in FIG. 18.

TABLE 3

| DATA BEFORE CONVERSION | DATA AFTER CONVERSION | | | |
|---|---|---|---|---|
| K | Y | M | C | K |
| 0 | 0 | 0 | 0 | 0 |
| 1 | 1 | 1 | 1 | 0 |

As can be seen from FIG. 18, by the data conversion which makes the alternate disposition of the first black dots, the number of first black dots formed within the 3×3 cells Co will be five at the most even in an area where cells Co having high black dot area ratios $S_k1$ aggregate. Thus, the black dot area ratios $S_k1$ by the first black dots do not exceed 5/9, and the black dots responsible for the other black dot area ratios $S_k1$ are formed as the second black dots.

Further, in an area where cells Co having high black dot area ratios Ski aggregate, the first black dot and the second black dot are disposed alternately. Thus, the slow-drying black ink forming the first black dots becomes adjacent to the fast-drying black ink forming the second black dots, thus facilitating permeation of the slow-drying black ink by the high permeability of the fast-drying black ink. As a result, the drying time of the slow-drying black ink is made shorter.

By the shorter drying time, the drying time D of the ink can be kept within a predetermined range even when the black dot area ratio after data conversion exceeds the maximum black dot area ratio Bmax.

The foregoing described the data conversion in the case where the ambient temperature Ta is about 25° C., and satisfies $T1 \leqq Ta \leqq T2$. The following explains the case where the ambient temperature Ta is not larger than T1 or not smaller than T2.

When the ambient temperature Ta is not larger than T1, for the described reasons, it is preferable to carry out data conversion with respect to the cells Co forming the black dots, because the maximum black dot area ratio Bmax is set to 0% (see FIG. 12). Here, even though data conversion may be carried out with respect to all cells Co forming black dots, in order to suppress deterioration of image quality, data conversion is preferably carried out only partially with respect to the cells Co forming black dots.

Specifically, data conversion is carried out with respect to some of the cells Co whose data K were "1" before data conversion (cells Co indicated by "K" in FIG. 16), and the data K and data Y, M, C of these cells Co are converted to "0" and "1", respectively.

Here, to select cells Co to be subjected to data conversion, the foregoing second condition is applied. This makes the first black dots and the second black dots adjacent to each other, thus facilitating drying of the slow-drying black ink.

On the other hand, when the ambient temperature Ta is not larger than T2, as described, it is preferable not to carry out data conversion, except for the cells satisfying the third condition, because the maximum black dot area ratio Bmax is set to 100% (see FIG. 12).

FlowChart

Figure 1:
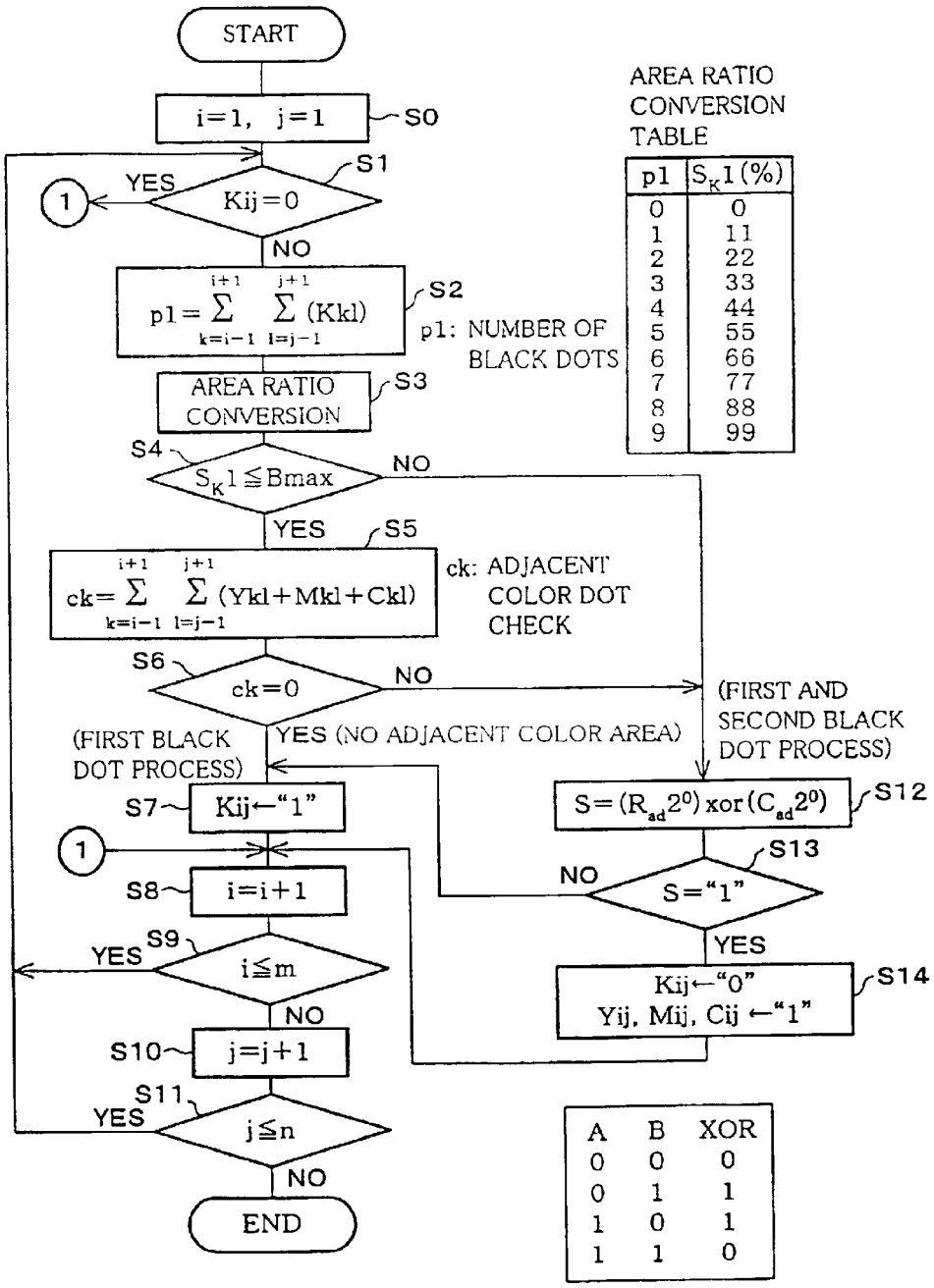
FIG. 1 is a flowchart showing a data process in accordance with one embodiment of the present invention.

The following will describe the foregoing process based on the flowchart of FIG. 1. FIG. 1 is a flow chat showing a data process in accordance with the present embodiment. In the process as shown in FIG. 1, each cell Co in the first column is taken as a target cell Ca one after another, and a dot pattern (black dot area ratio $S_k1$ and color of dots formed in adjacent cells) of the target cell Ca is determined to suitably carry out data conversion. This process is repeated to the nth column.

Note that, for convenience of explanation, it is assumed that data D after conversion is stored separately from data D before conversion, and the data D before conversion used in the following steps do not change. Also, the ambient temperature Ta here is about 25° C., and the flowchart of FIG. 1 shows the process after it was decided by ambient temperature Ta.

First, in step 0 (step will be abbreviated to "S" hereinafter), the target cell $Ca_{ij}$ is set at (i, j)=(1, 1) as the initial value. Then, it is judged in S1 whether the target cell $Ca_{ij}$ has the black data. If it is judged in S1 that the target cell $Ca_{ij}$ has the black data (data $K_{ij}$=1), the sequence goes to S2, and if the target cell $Ca_{ij}$ does not have the black data (data $K_{ij}$=0), the sequence goes to S8.

In S2, the number of cells Co having the black data (data K=1) in the target cell area is counted by the process of the filter of 3 rows×3 columns, and the resulting value is given as the number of black dots p1.

Here, the target cell area is fixed at 3 rows×3 columns, and thus, to actually determine the black dot area ratio $S_k1$ from the number of black dots p1, the black dot area ratio $S_k1$ is preferably determined using an area ratio conversion table TBL, which is the table which indicates correspondence between the number of black dots p1 and the black dot area ratio $S_k1$ without performing division. As a result, the time required for calculating the black dot area ratio $S_k1$ can be significantly reduced. This conversion is carried out in S3. Note that, the number of black dots p1 may alternatively be used directly in the judgement in S4.

Then, in S4, the target cell $Ca_{ij}$ is judged with respect to the black dot area ratio $S_k1$. If the black dot area ratio $S_k1$ is at or below the maximum black dot area Bmax, the sequence goes to S5.

Then, it is judged in S5 whether the target cell area (cells Co of 3 rows×3 columns) around the target cell $Ca_{ij}$ at the center has a color dot. Specifically, the sum of data Y, M, C in the target cell area is substituted in adjacent color dot check ck. Thus, when there is a color dot, the adjacent color dot check becomes ck≧1, and when there is no color dot, the adjacent color dot check becomes ck=0.

Then, the adjacent dot check ck thus determined in S5 is judged in S6. Here, when there is no data D which forms the color dot in the target cell area, i.e., when ck=0, the first black data (data $K_{ij}$=1) is applied to the data $D_{ij}$, of the target cell $Ca_{ij}$ (no data conversion). Note that, the process of S7 is referred to as a first image forming process.

On the other hand, if the black dot area ratio $S_k1$ exceeds the maximum black dot area ratio Bmax in S4, or if there exists data D which forms a color dot in S6, address rad2° and address Cad2° of the target cell $Ca_{ij}$ are subjected to exclusive OR in S12, and the resulting value is given as exclusive OR S. Thereafter, the exclusive OR S is judged in S13, and if it is "0", the sequence goes to S7 and the first black data (data $K_{ij}$=1) is applied to the data Di,of the target cell $Ca_{ij}$ (no data conversion).

If the exclusive OR S is "1" in S13, the second black data (data $Y_{ij}$, $M_{ij}$, $C_{ij}$=1, and data $K_{ij}$=0) is applied to the target cell $Ca_{ij}$ in S14 (data conversion). Note that, the process from S12 to S14 (including S7) is referred to as a second image forming process.

When the data $D_{ij}$ of the target cell $Ca_{ij}$ is decided in S7 or S14, the sequence goes to S8 and i is incremented by 1 therein (i.e., shifted to the next row). This process is repeated until i=m in S9. When i=m, and the first column has been processed, the sequence goes to S10 and j is incremented by "1" (i.e., shifted to the next column). The process is finished after repeating the process to j=n in S11.

Note that, under the condition where the ambient temperature Ta is not more than the first temperature T1, if the target cell $Ca_{ij}$ has the black data (data $K_{ij}$=1) in S1, the sequence goes to S12.

On the other hand, under the condition where the ambient temperature Ta is not less than the second temperature T2, data conversion is carried out only at the boundary with the color dots. Thus, if the target cell $Ca_{ij}$ has the black dot (data $K_{ij}$=1) in S1, the sequence goes to S5.

The foregoing described the case where the black dot stores "0" or "1" as the data K in each cell Co, i.e., a method of calculating the black dot area ratio $S_k1$ in bit unit. However, not limiting to this, the same process can also be carried out when the dot size of the heads 11$K_1$, 11$K_2$, 11$K_3$, and 11Y, 11M, 11C is variable, and the data D of each cell Co has been modulated with respect to its dot size. In this case, the following process is preferably carried out.

First, a black dot area ratio $S_k2$ (will be defined in the Second Embodiment), which takes into consideration the dot size is calculated with respect to the target cell Ca, for example, by the 3×3 dot filter. When the black dot area ratio $S_k2$ exceeds the maximum black dot area ratio Bmax, and when the exclusive OR of the target cell Ca takes the value "1", the color dots of Y, M, C are overlaid by the relationship of correspondence of dot size (ratio with respect to ideal dot size) as shown in Table 4. The values of data Y, M, C, and K in Table 4 indicate dot size.

TABLE 4

| DATA BEFORE CONVERSION | DATA AFTER CONVERSION | | | |
|---|---|---|---|---|
| K | Y | M | C | K |
| 0 | 0 | 0 | 0 | 0 |
| 25 | 25 | 25 | 25 | 0 |
| 50 | 50 | 50 | 50 | 0 |
| 75 | 75 | 75 | 75 | 0 |
| 100 | 100 | 100 | 100 | 0 |

Also, data conversion may be carried out taking into consideration dot size of the target cell Ca. This will be described in the Second Embodiment.

As described, the ink-jet image forming method of the present embodiment detects ambient temperature Ta of an image forming area, and selects an ink to be used to form a dot from the slow-drying ink and the fast-drying ink based on the detected ambient temperature Ta.

Further, it is preferable that the ink-jet image forming method of the present embodiment recognizes, based on image data, the print area ratio $S_o1$ of the dots formed in an area which has been set beforehand on an image with respect to the dot point of the dot to be formed, and selects the ink to be used to form the dot based on the print area ratio $S_o1$.

As a result, it is possible to control the drying time D of the ink to allow the ink to dry within a predetermined time period, by adjusting the ink in such a manner that less slow-drying ink is used and the fast-drying ink is used to make up for the slow-drying ink in accordance with the temperature condition of image formation, or the image to be formed, thereby increasing print speed.

Also, with the foregoing method, deterioration of image quality can be suppressed by improving reproducibility of color by adjusting the ink so that the slow-drying ink is used as much as possible within a range which allows for drying of the ink within a predetermined time period.

Note that, when selecting ink based on the ambient temperature Ta and print area ratio $S_o1$, the acceptable limit of the print area ratio $S_o1$ of the dots to be formed by the slow-drying ink is set in advance as the maximum dot area ratio (maximum dot density) based on the temperature characteristics of the slow-drying ink with respect to the ambient temperature Ta, and the print area ratio $S_o1$ is compared with the maximum dot area ratio which corresponds to the detected ambient temperature Ta. The maximum dot area ratio can be set based on the print area ratio $S_o1$ of the slow-drying ink, which allows the slow-drying ink to dry within a predetermined time period.

In an area where the print area ratio $S_o1$ exceeds the maximum dot area ratio, it is preferable to adjust the dots of the slow-drying ink and the dots of the fast-drying ink so that they are disposed alternately.

That is, it is preferable that the acceptable limit (maximum dot area ratio) of dot density of the dots to be formed by the slow-drying ink is set in advance based on the relationship between the print area ratio $S_o1$ and drying time D of the slow-drying ink with respect to the ambient temperature Ta, and an image is formed by the slow-drying ink in an area where the dot density does not exceed the acceptable limit, and an image is formed by the slow-drying ink together with the fast-drying ink in an area where the dot density exceeds the acceptable limit.

As a result, the drying time D can be suppressed not to exceed a desired set value while suppressing deterioration of image quality, thus providing an ink-jet image forming method which requires less time for forming an image, and which can form a high quality image.

Specifically, since drying time D of the ink becomes shorter when the ambient temperature Ta is high, the slow-drying black ink is used in this case to form black dots even in an area of a relatively high black dot area ratio $S_k1$, so as to improve image quality by improving reproducibility of black.

On the other hand, drying time D of the ink becomes longer when the ambient temperature Ta is low, and thus, in this case, the slow-drying black ink is suitably used with the fast-drying black ink to form black dots even in an area of a relatively low black dot area ratio $S_k1$ so as to prevent the drying time D of the ink to become even longer. Especially, the permeation of the slow-drying black ink can be facilitated by forming the black dots of the fast-drying black ink adjacent to or over the black dots of the slow-drying black ink to effectively shorten the drying time D.

By thus using the slow-drying black ink as much as possible within a range which can maintain a constant drying time D of the black ink to be used to form an image, deterioration of image quality can be suppressed. As a result, image quality can be improved while preventing slowing of the image forming rate.

The ink-jet image forming device of the present embodiment for implementing the foregoing method includes, as shown in FIGS. 2, 3, and 13, slow-drying ink ejecting means (black head block 10*a*) for ejecting the slow-drying ink, fast-drying ink ejecting means (color head block 10*b*) for ejecting the fast-drying ink, temperature detecting means (temperature detecting device 24) for detecting ambient temperature Ta of an image forming area, and control means (control device 22) for selecting the ejecting means to be used to eject ink, from the slow-drying ink ejecting means and the fast-drying ink ejecting means based on the detected ambient temperature Ta.

The ink-jet image forming device of the present embodiment may further include calculation means (area ratio processing circuit 38) for calculating, based on image data, density (print area ratio $S_o1$) of the ink ejected in a predetermined area of an image, wherein the control means selects the ejecting means for ejecting the ink, based on the ink density thus calculated.

With the foregoing ink-jet image forming device, the drying time D of the ink can be made shorter than a pre-set value, and thus it is not required to provide the dryer 16 (see FIG. 2), or the size or output thereof can be reduced. Therefore, a simpler, smaller, less expensive, and less power consuming device can be realized with the ink-jet image forming device of the present embodiment.

Note that, even though the foregoing explanation was primarily based on the cells Co on the memory map, since cells Co and dots correspond to each other one to one, the descriptions which relate to the cells Co and the target cell area can also to suitably applied to dots and target dot area.

Further, even though the described embodiment defined the print area ratio $S_o1$ as the value which indicates dot density, the present invention is not just limited to the foregoing definition, and the value which indicates dot density may be defined by other ways. Specifically, the target cell area may also be defined, for example, by an area of a cross-shape made up of five cells Co which include cells Co adjacent to a target cell Ca in the row and column directions.

Further, even though the present embodiment was intended for solid black images, it is also applicable to the inks of other colors.

Second Embodiment

The following will describe the Second Embodiment of the present invention with reference to FIG. 19 through FIG. 22.

Note that, a dot forming method employing the ink-jet system in accordance with the present embodiment is to be applied to the color ink-jet printer 2 as described in the First Embodiment based on FIGS. 2, 3, 13, and 14, and therefore the elements making up the structure of this device will be directly referred to with the same reference numerals, and explanations thereof are omitted here. Also, various terms used in the First Embodiment will be directly referred to as defined therein unless otherwise noted.

Dot Size

The First Embodiment chiefly described the case where the dot size of the dots making up the print image is the same (fixed dot size). The present embodiment describes the case where the dot size is variable (modulated dot size).

The present embodiment differs from the First Embodiment in data D stored in each cell Co of the line memory 36 (see FIG. 13 and FIG. 14). That is, while data D had the value of either "1" or "0" in the First Embodiment depending on whether a dot is to be formed, in the present embodiment, data D has a value which indicates the dot size of a dot to be formed.

Specifically, the data D has the value of a proportion with respect to an ideal dot size. Here, the dot size of a dot formed is 100%, 75%, 50%, or 25% with respect to an ideal dot size, and their corresponding data D have the values 100%, 75%, 50%, and 25%, respectively.

The following explains how dots overlap when dots of respective dot sizes are formed. Table 5 shows presence or absence of overlapping dots between a dot of a target point and dots of adjacent points, when dots of respective dot sizes are formed on the target point and dots of respective dot sizes are formed on adjacent points in horizontal, vertical (row, column), and oblique directions with respect to the target point.

TABLE 5

| DOT OF TARGET POINT | | ADJACENT DOTS | | | | | | | |
|---|---|---|---|---|---|---|---|---|---|
| DOT PITCH | DOT | HORIZONTAL AND VERTICAL DIRECTIONS | | | | OBLIQUE DIRECTION | | | |
| RATIO | SIZE | 100% | 75% | 50% | 25% | 100% | 75% | 50% | 25% |
| 1.41 | 100% | X | X | X | ○ | X | ○ | ○ | ○ |
| 1.06 | 75% | X | X | ○ | ○ | ○ | ○ | ○ | ○ |
| 0.70 | 50% | X | ○ | ○ | ○ | ○ | ○ | ○ | ○ |
| 0.35 | 25% | ○ | ○ | ○ | ○ | ○ | ○ | ○ | ○ |

In Table 5, "X" indicates overlapping dots between a dot of the target point and a dot of an adjacent point, and "○" indicates no overlap. Also, "dot pitch ratio" indicates the ratio of dot size to dot pitch.

As can be seen from Table 5, when the dot size of a dot of the target point is 50%, the only case where dots overlap is when the dot size of a dot of the target point is 50%, and when there exists an adjacent dot of the 100% dot size in the horizontal or vertical direction. It can be seen that even in this case that, considering the dot pitch and the dot size, the area of overlapping portion is small.

Thus, in the present embodiment, the condition of data conversion (fourth condition) is when the dot of the target point is the black dot having a dot size which exceeds 50%, i.e., when data K stored in the target cell Ca exceeds 50% (data K=75%, 100%)

Conversion of Print Data

The following will describe conditions for carrying out data conversion by the density of black dots in an area including the target point. First, in the case where the dot size is modulated, the following equation is used to define black dot area ratio $S_k2$ (dot area ratio) as the value which indicates density of black dots in a predetermined area made up of dot points of m rows×n columns $$(\text{black dot area ratio } S_k2)=p2/(m\times n).$$

where p2 indicates a total dot size (%) of black dots formed in the predetermined area, m indicates the number of rows of the dot points in the predetermined area, and n indicates the number of columns of the dot points in the predetermined area.

Here, as with the First Embodiment, the black dot area ratio $S_k2$ of the target cell area of 3 rows×3 columns surrounding the target cell Ca at the center is given as the black dot area ratio $S_k2$ of the target cell Ca. Also, as with the First Embodiment, the condition of data conversion (fifth condition) is when the black dot area ratio $S_k2$ of the target cell Ca exceeds the maximum black dot area ratio Bmax.

The dot of the target point which corresponds to the target cell Ca which satisfies the fourth and fifth conditions is formed as follows. As described, dots having the dot size of 50% or below either do not overlap, or have a small overlap area even when they overlap. Thus, even when the dot of the target point satisfies the fourth and fifth conditions, the area which corresponds to the 50% dot size is formed by the first black dot, and the remaining area of the black dot is supplemented by the second black dot.

Here, it is preferable that the second black dot is formed first, and then the first black dot is overlaid thereon, for example, concentrically. In this manner, permeation of the ink making up the first black dot into the recording sheet (see FIG. 3) can be facilitated by the second black dot, thus making the drying time D shorter. Also, since the first black dot is on the upper side, reproducibility of black does not suffer on the print image.

Specifically, when the dot size of the dot on the target point which satisfies the fourth and fifth conditions is 75% or 100%, first, the second black dot of the 50% dot size or 75% dot size is formed in each case, and the first black dot of the 50% dot size is formed thereon (may be referred to as "75% overshoot" and "100% overshoot", respectively). Note that, the dot size of the second black dot is decided as described above, taking into consideration spreading of the dot over the recording sheet P.

On the other hand, the dot of the target point of the target cell Ca which does not satisfy the fourth condition (dots of 25% dot size and 50% dot size) either does not overlap, or have a small overlap area even when they overlap, and therefore the drying time D of the ink is short. Thus, the dot on this target point is preferably formed by the first black dot of these dot sizes.

Also, the dot of the target point of the target cell Ca which does not satisfy the fifth condition has low density of black dots of the surrounding black dots, and thus have a short drying time D as with the foregoing case, and therefore it is preferable to form the dot by the first black dot of this dot size.

Note that, as with the First Embodiment, even for a dot of the target point of the target cell Ca which does not satisfy the fifth condition, such a dot is formed as if it satisfies the fourth and fifth conditions when the dot is at the boundary with the color area, i.e., when a color dot exists in the target dot area (sixth condition), and when the fourth condition is satisfied.

The following explains data conversion for forming dots in the foregoing manner with reference to FIG. 19 through FIG. 21. FIG. 19 through FIG. 21 are explanatory drawings which show data conversion in the print data area 50 of the line memory 36, in which FIG. 19 shows data D before conversion, FIG. 20 shows black dot area ratio $S_k2$ of each cell Co, and FIG. 21 shows data D after conversion.

Note that, in FIG. 19 through FIG. 21, cells Co forming black dots are indicated by the oblique lines. Also, cells Co forming color dots are indicated simply by "Y", "M", or "C".

First, in the print data area 50 having data D in FIG. 19, the black dot area ratio $S_k2$ of each cell Co is successively determined with respect to all cells Co having black data. The resulting black dot area ratio $S_k2$ of each cell Co is as shown in FIG. 20. Note that, the black dot area ratio $S_k2$ is not necessarily stored in each cell Co, but FIG. 20 shows black dot area ratio $S_k2$ corresponding to each cell Co for convenience of explanation.

Whether the target cell Ca satisfies the fourth condition or sixth condition is judged based on data D before conversion shown in FIG. 19. Further, whether the target cell Ca satisfies the fifth condition is judged by the black dot area ratio $S_k2$ shown in FIG. 20. Data conversion is carried out when the fourth and fifth conditions, or fourth and sixth conditions are satisfied.

Table 6 shows correspondence in data conversion between data K of the target cell Ca before conversion and data Y, M, C, K thereof after data conversion. Note that, Table 6 is based on the case where the fifth or sixth condition is satisfied.

TABLE 6

| DATA BEFORE CONVERSION | DATA AFTER CONVERSION | | | |
|---|---|---|---|---|
| K | Y | M | C | K |
| 0 | 0 | 0 | 0 | 0 |
| 25 | 0 | 0 | 0 | 25 |
| 50 | 0 | 0 | 0 | 50 |
| 75 | 50 | 50 | 50 | 50 |
| 100 | 75 | 75 | 75 | 50 |

Note that, in FIG. 21, cells Co forming only the first black dots are indicated by their dot size, and cells Co to be subjected to 75% overshoot and 100% overshoot are indicated by "50 ymc" and "50 YMC", respectively.

Flowchart

Figure 22:
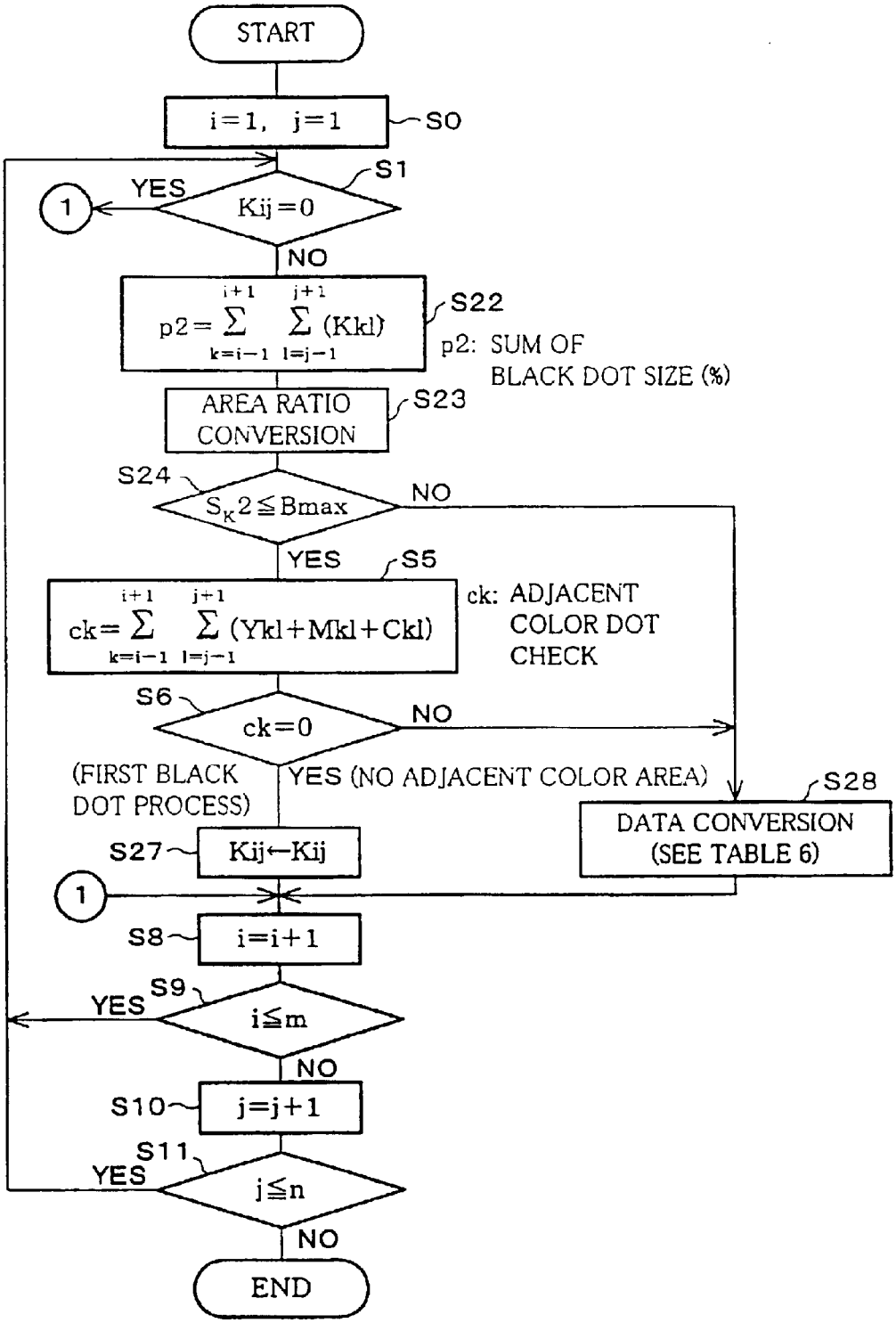
FIG. 22 is a flowchart showing a data process in accordance with the Second Embodiment of the present invention.

The following describes the foregoing process based on the flowchart of FIG. 22. FIG. 22 is a flowchart showing a data process in accordance with the present embodiment. Note that, in the flowchart of FIG. 22, the steps intended for the same process as those of the flowchart in FIG. 1 are given the same reference numerals and their explanations are partially omitted.

After carrying out S0 to S1 as in the First Embodiment, S22 is carried out. In S22, by the process of the 3 rows×3 columns filter, the sum of data K of cells Co having the black data (data K>0) in the target cell area is determined, i.e., the sum of dot sizes of the black dots in the target cell area is determined, which is given by the sum p2 of the dot sizes of the black dots.

Here, as with the First embodiment, the target cell area is fixed by the 3 rows and 3 columns, and thus in order to actually determine the black dot area ratio $S_k2$ from the sum p2 of the dot sizes of the black dots, it is preferable to determine the black dot area ratio $S_k2$ using an area ratio conversion table (not shown) which indicates correspondence between the sum p2 of the dot sizes of the black dots and the black dot area ratio $S_k2$, without performing division. This significantly saves time required for the calculation process of the black dot area ratio $S_k2$. The conversion is carried out in S23. Note that, the sum of the dot sizes of the black dots may alternatively be directly used in the judgement of S24.

Then, in S24, the target cell $Ca_{ij}$ is judged with respect to the black dot area ratio $S_k2$. If the black dot area ratio $S_k2$ is not more than the maximum black dot area ratio Bmax, the sequence goes to S5, and the adjacent color dot check ck which was determined in S5 is judged is S6. Here, when there exists no data D which forms a color dot in the target cell area, i.e., when ck=0, the original black data (data $K_{ij}$) is applied to the target cell $Ca_{ij}$ in S27 (no data conversion). Note that, the process of S27 is referred to as the first image forming process as in S7.

Meanwhile, when the black dot area ratio $S_k2$ exceeds the maximum black dot area ratio Bmax in S24, or when there exists data D which forms a color dot in S6, data conversion is suitably carried out based on Table 6 in S28. Note that, the process of S28 is referred to as a third image processing process.

Upon deciding data D of the target cell $Ca_{ij}$ in S27 or S28, the subsequent processes are the same as those of the First Embodiment.

As described, by the ink-jet image forming method of the present embodiment, image quality can be improved while suppressing increase in drying time D due to the slow-drying ink, as with the First Embodiment, even when the dot size is variable.

Further, the ink-jet image forming method of the present embodiment is preferably adapted to have overlaid slow-drying ink and fast-drying ink when carrying out the third image forming process. This improves permeability of the slow-drying ink by the permeability of the fast-drying ink, thereby making drying time of the slow-drying ink shorter.

As described, the ink-jet image forming methods in accordance with the First and Second Embodiments are for forming an image by forming a dot using the slow-drying ink having a relatively longer drying time and the fast-drying ink having a relatively shorter drying time, wherein: an ambient temperature of an area where the image is formed is detected, and an ink to be used to form the dot is selected from the slow-drying ink and the fast-drying ink based on the ambient temperature detected.

The slow-drying ink has such characteristics that its viscosity changes depending on the ambient temperature of a portion where an image is formed, and its permeation rate in the recording sheet also changes depending on the ambient temperature. For example, the higher the ambient temperature, the faster the permeation rate, and the lower the ambient temperature, the slower the permeation rate. Further, the drying time of the slow-drying ink is influenced by the permeation rate of the fast-drying ink, such that the faster the permeation rate, the shorter the drying time, and the slower the permeation rate, the longer the drying time.

Thus, in the foregoing methods, the ink to be used is selected from the slow-drying ink and the fast-drying ink when forming an image, based on an ambient temperature of a portion where the image is formed. This allows for adjustment of an ink in accordance with temperature conditions of image formation, so as to use less slow-drying ink and use the fast-drying ink instead, thereby controlling drying time of the ink so that the ink is dried within a predetermined period of time. As a result, a print speed can be increased.

Further, the foregoing methods may be adapted to adjust the use of an ink so as to use the slow-drying ink as much as possible within a range which allows the ink to dry within a predetermined period of time, thereby suppressing deterioration of image quality by improving reproducibility of color. As a result, it is possible to provide the ink-jet image forming method which is capable of preventing deterioration of image quality while increasing print speed.

Further, it is preferable in the foregoing ink-jet image forming methods that dot density of a predetermined area on the image is recognized with respect to the dot based on image data which is used to form the image, and the ink to be used to form the dot is selected based also on the dot density recognized.

The drying time of the dots formed with the slow-drying ink is also influenced by dot density of surrounding dots. That is, the higher the dot density, the longer the drying time, and the lower the dot density, the shorter the drying time.

Thus, in the foregoing methods, the ink to be used to form the dot is selected from the slow-drying ink and the fast-drying ink based on an ambient temperature of a portion where an image is formed and based on dot density of dots which are formed in a pre-defined area with respect to the dot formed in the image area.

With this method, when it is difficult to dry the ink, i.e., when the ambient temperature is low and dot density is high, for example, the dot density of the slow-drying ink can be reduced by using the fast-drying ink instead of the slow-drying ink for a portion of the dot to be formed with the slow-drying ink, taking into consideration ambient temperature of image formation and dot density of an image to be formed. As a result, drying time of the ink can be made shorter and print speed can be increased.

Alternatively, the dot density of the slow-drying ink can be made as high as possible within a range which can maintain a required print speed, thereby suppressing deterioration of image quality.

As a result, it is possible to provide the ink-jet image forming methods which can increase print speed and prevent deterioration of image quality further effectively.

Further, it is preferable in the foregoing ink-jet image forming methods, in which dot density is recognized, that the dot density of the dots formed with the slow-drying ink is set to have an acceptable limit as maximum dot density with respect to the ambient temperature, based on temperature characteristics of the slow-drying ink, and the dot density recognized and the maximum dot density which corresponds to the detected ambient temperature are compared, and the ink to be used to form the dot is selected based on a result of comparison.

In the foregoing methods, an acceptable limit is set for dot density of the slow-drying ink as maximum dot density with respect to an ambient temperature based on temperature characteristics of the slow-drying ink. In image formation, the dot density recognized and the maximum dot density at the detected ambient temperature are compared, so as to select, based on the result of comparison, an ink to be used to form the dot.

With the foregoing methods, ink can be selected by simply comparing the pre-set maximum dot density and the dot density recognized. As a result, there will be no complication in processes such as a calculation for selecting an ink in image formation.

Note that, the maximum dot density can be set, for example, using as a reference dot density of the slow-drying ink at which the slow-drying ink can be dried within a predetermined time period.

Further, it is preferable in the foregoing ink-jet image forming methods, in which maximum dot density is set, that a function which equates the ambient temperature and the maximum dot density is set, and the maximum dot density with respect to the detected ambient temperature is determined using the function.

The foregoing methods are adapted to set a function which equates the ambient temperature and the maximum dot density, and the maximum dot density which corresponds to the ambient temperature which was detected in image formation is determined using this function. This allows the maximum dot density to be determined from a detected arbitrary temperature. As a result, ink can be selected under strict judgement, thus selecting an ink further suitably.

Note that, the function is preferably, for example, an approximation which approximates the relationship between ambient temperature and maximum dot density. Here, while more accurate approximation is possible with approximation by a second order or greater function, approximation by a first order function can also produce results which are accurate enough.

Further, it is preferable in the foregoing ink-jet image forming methods that the ink to be used to form the dot is selected by switching: a first image forming process for forming the dot using the slow-drying ink; and a second image forming process for forming the dot using either one of the slow-drying ink and the fast-drying ink based on a position where the dot is formed.

In the foregoing methods, as described, an ambient temperature is detected in image formation and dot density is recognized, based on which the dot is formed by switching the first image forming process for forming the dot using only the slow-drying ink and the second image forming process which uses either one of the slow-drying ink and the fast-drying ink.

In the foregoing methods, under the condition where the drying speed of the ink tends to be fast, i.e., low dot density and high ambient temperature, the dots are formed using the slow-drying ink so as to suppress deterioration of image quality. On the other hand, under the condition where the drying speed of the ink tends to be slow, i.e., high dot density and low ambient temperature, the dots are formed so that the slow-drying ink and the fast-drying ink are disposed, for example, alternately (adjacently). This makes it possible to make the drying time of the slow-drying ink shorter.

As a result, a print speed can be increased while suppressing deterioration of image quality according to conditions of image formation and the image to be formed.

Further, it is preferable in the foregoing ink-jet image forming methods that the ink to be used to form the dot is selected by switching: a first image forming process for forming the dot using the slow-drying ink; and a third image forming process for forming the dot using both the slow-drying ink and the fast-drying ink based on a position where the dot is formed.

In the foregoing methods, as described, an ambient temperature is detected in image formation and dot density is recognized, based on which dot is formed by switching the first image forming process for forming the dot using only the slow-drying ink and the third image forming process which uses both the slow-drying ink and the fast-drying ink based on a position where the dot is formed.

In the foregoing methods, under the condition where the drying speed of the ink tends to be fast, i.e., low dot density and high ambient temperature, the dot is formed using the slow-drying ink so as to suppress deterioration of image quality. On the other hand, under the condition where the drying speed of the ink tends to be slow, i.e., high dot density and low ambient temperature, the dot is formed using both the slow-drying ink and the fast-drying ink so as to make the drying time shorter.

As a result, a print speed can be increased while suppressing deterioration of image quality according to conditions of image formation and the image to be formed.

Further, it is preferable in the foregoing ink-jet image forming methods, in which the second image forming process is carried out, that the second image forming process is carried out when the ambient temperature is not more than a pre-set first temperature.

Alternatively, it is preferable in the foregoing ink-jet image forming methods, in which the third image forming process is carried out, that the third image forming process is carried out when the ambient temperature is not more than the pre-set first temperature.

In the foregoing methods, under the condition where the ambient temperature of a portion where the image is formed is low and it is difficult to dry the slow-drying ink, the second or third image forming process is carried out. This shortens the drying time of the ink under low ambient temperature conditions, and the print speed can be increased. Also, this method does not require recognition of dot density when the ambient temperature is not more than the first temperature, thus simplifying the calculation process.

Further, it is preferable in the foregoing ink-jet image forming methods, in which the first image forming method is carried out, that the first image forming process is carried out when the ambient temperature is not less than a pre-set second temperature.

In the foregoing methods, under the condition where the ambient temperature of a portion where the image is formed is high and the slow-drying ink is easily dried, the first image forming process which uses the slow-drying ink is carried out. This improves image quality under high ambient temperature conditions. Also, this method does not require recognition of dot density when the ambient temperature is not less than the second temperature, thus simplifying the calculation process.

Note that, the foregoing temperatures which were used as a reference in the foregoing methods may be, for example, a temperature which allows an ink to dry within a predetermined time period when dots by the slow-drying ink were formed so that the dot density of the dots has the maximum value. Further, it is preferable in the foregoing ink-jet image forming methods, in which the third image forming process is carried out, that the slow-drying ink and the fast-drying ink are overlaid one over another when carrying out the third image forming process.

The foregoing methods are adapted to form the dot by overlaying the slow-drying ink and the fast-drying ink. In these methods, the permeability of the slow-drying ink is improved by the permeation of the fast-drying ink, thus making the drying time of the slow-drying ink shorter. For example, there are cases where drying time becomes longer under low temperature conditions even when dot density of the dots by the slow-drying ink is low and each dot is isolated. With the foregoing methods, drying time of the ink can be made shorter by the foregoing action even in such a case.

Third Embodiment

The following will describe a Third Embodiment of the present invention with reference to FIG. 23 through FIG. 35.

Overall Device Structure

Figure 23:
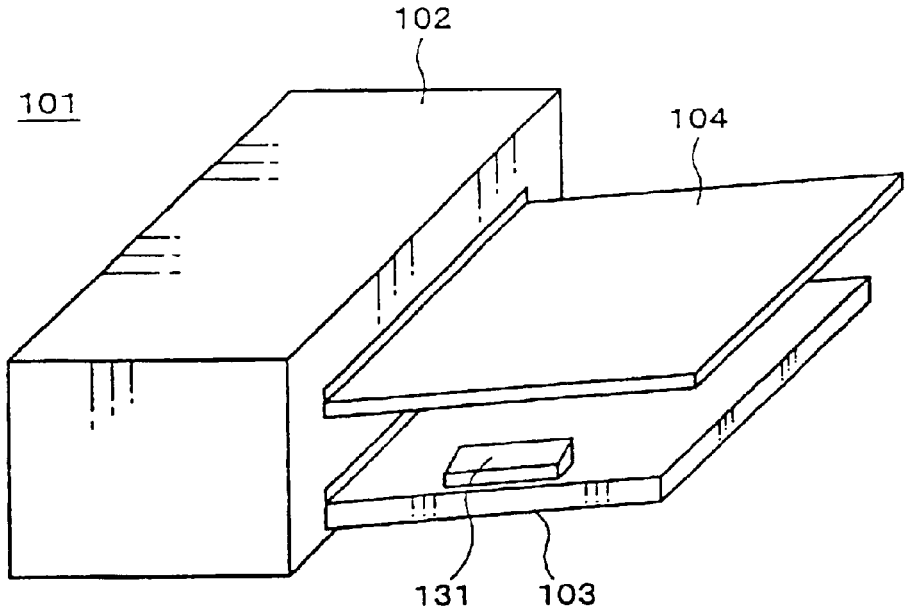
FIG. 23 is a perspective view showing an external view of a color ink-jet printer in accordance with a Third Embodiment of the present invention.
Figure 24:
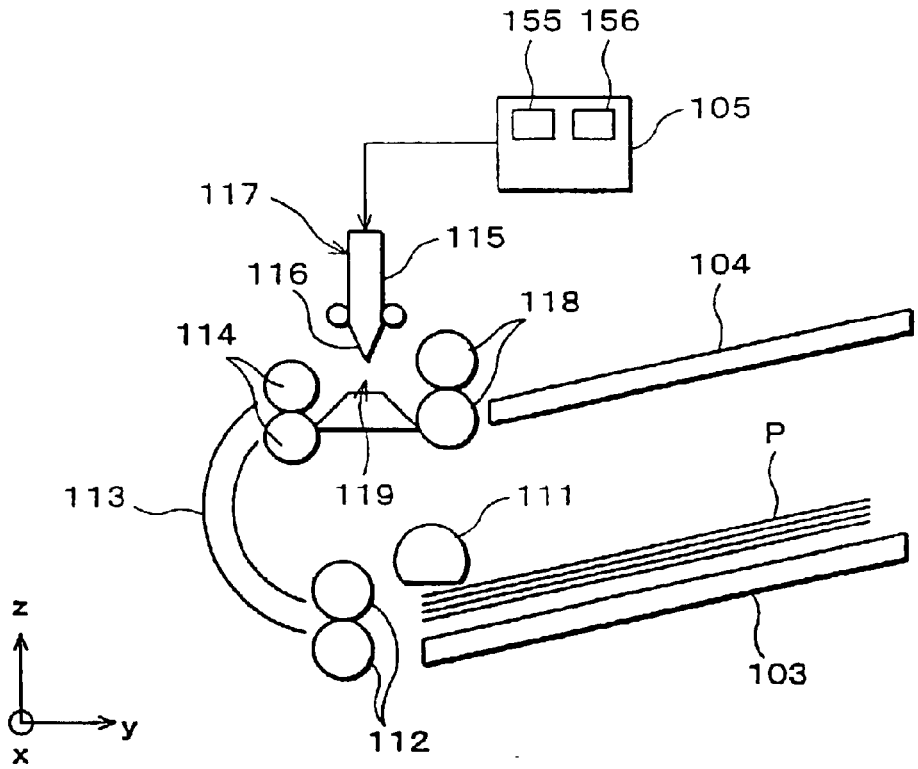
FIG. 24 is a drawing showing an internal structure of the color ink-jet printer of FIG. 23.

First, a structure of a color ink-jet printer in accordance with the present embodiment is described based on FIG. 23 and FIG. 24. FIG. 23 is a perspective view showing an external view of the color ink-jet printer 101. FIG. 24 is a drawing which shows an internal structure of the color ink-jet printer 101.

The color ink-jet printer 101 has a feeder tray 103 on a front side (right side in FIG. 23) of a cabinet 102, and a discharge tray 104 above the feeder tray 103 on the front side of the cabinet 102. On the feeder tray 103 is provided a positioning element 131 for deciding a feeding position of a recording sheet P placed thereon.

Meanwhile, as shown in FIG. 24, inside the cabinet 102 are provided, from the feeder tray 103 to the discharge tray 104, a pick-up roller 111, feeder rollers 112, a transport path 113 of a near U-shape, PS rollers 114, an ink carriage 117, and discharge rollers 118 in this order. The ink carriage 117 has an ink tank 115 and an ink head 116. Further, the color ink-jet printer 101 has a control device 105 for controlling each element. Note that, the following processes and operations of the color ink-jet printer 101 are controlled by the control device 105 unless otherwise noted.

When the print operation of the color ink-jet printer 101 is started, first, one of the recording sheet P stored in the feeder tray 103 is picked up by the pick-up roller 111 and is guided to the transport path 113 by the feeder rollers 112. The recording sheet P is then transported to an image forming position 119 facing the ink carriage 117. Then, while the recording sheet P is passing the image forming position 119, an image is formed with respect to the recording sheet P by ejecting an ink from the ink head 116 of the ink carriage 117, based on the position of the recording sheet P and print data (described later). Specifically, when the recording sheet P is transported to the image forming position 119, the ink carriage 117 ejects an ink by moving in a vertical direction with respect to the plane of the paper in FIG. 24 to form an image on the recording sheet P. When the ink carriage 117 has moved to one end of the recording sheet P, the recording sheet P is moved (transported) by a predetermined distance before coming to a halt. Then, the ink carriage 117 again moves in a vertical direction with respect to the plane of the paper in FIG. 24 to form an image. In this manner, an image is formed on the recording sheet P by alternately carrying out the image forming operation by the ink carriage 117 and the transport operation of the recording sheet P.

The recording sheet P on which the image was formed is then discharged toward the discharge tray 104 by the discharge rollers 118. That is, the recording sheet P on which a predetermined image was formed is discharged to the discharge tray 104 face-up (image facing upward).

Figure 25:
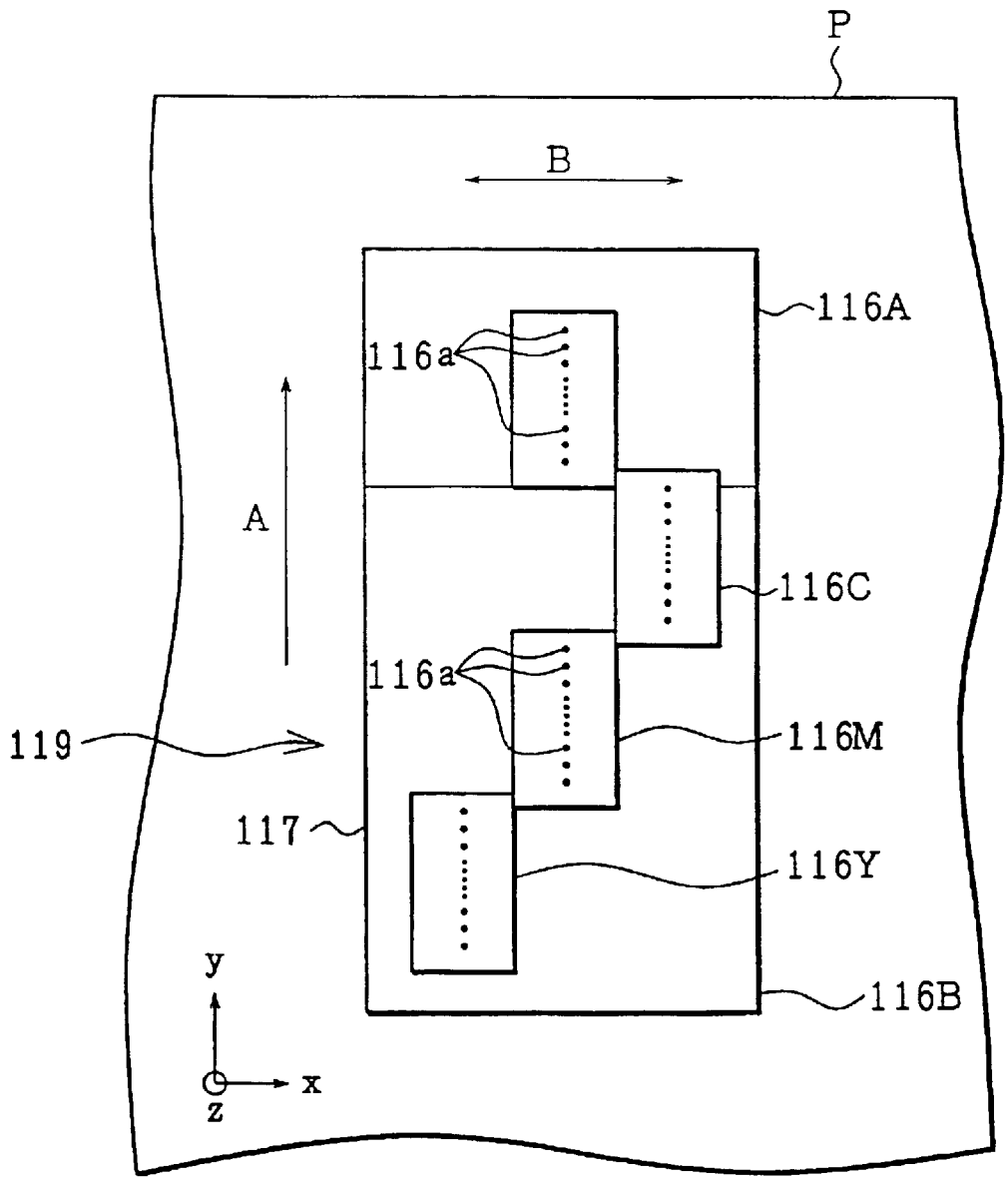
FIG. 25 is a drawing showing how nozzles are disposed when viewed down in a direction from an ink head of the color ink-jet printer of FIG. 23 to the recording sheet.

The following defines directions in the color ink-jet printer 101 based on FIG. 25, as in the First Embodiment. As shown in FIG. 25, a direction normal to the recording sheet P in the image forming position 119 is z direction, a moving direction of the recording sheet P (direction of arrow A in FIG. 25) in the image forming position 119 is y direction, and a direction orthogonal to the z and y directions is x direction. These directions are common to FIG. 24 and FIG. 25.

Ink Head Structure and Definition of Dots

The following describes a structure of the ink head 116 based on FIG. 25. FIG. 25 shows a disposition of nozzles 116*a* when the nozzle head 116 is viewed from above (direction toward the recording sheet P from the ink head 116).

The ink head 116 is composed of a black head black 116A and a color head black 116B. The color head black 116B includes a cyan head 116C, a magenta head 116M, and an yellow head 116Y, corresponding to their respective colors of cyan (C), magenta (M), and yellow (Y).

The heads 116A, 116C, 116M, and 116Y each has, for example, 64 nozzles 116*a* for ejecting their respective inks, and has a resolution of 600 dpi.

The amount of ink ejected, ink density, and process conditions of each head 116A and 116B are, for example, as shown in Table 1 of the First Embodiment. Also, the inks may have the compositions, for example, as shown in Table 2 of the First Embodiment.

The ink carriage 117 is mounted on a driving mechanism (not shown) so as to be movable in a head moving direction (direction of arrow B in FIG. 25), i.e., a direction orthogonal to direction A which is the sheet transport direction. An image is formed by the ON/OFF control of ink ejection from the nozzles 116*a* based on print data (mentioned later), position of the recording sheet P, and position of the ink head 116.

Note that, the terms as defined in the First Embodiment, such as "dot", "dot size", "dot point", and "dot pitch" will also be used in the present embodiment. Further, the following description will also based on the case where dot points are disposed in row and column directions, and the distance (dot pitch) between adjacent dot points in row and column directions is the same with respect to each dot point.

Print Area Ratio

As in the First embodiment, it is also assumed in the present embodiment that the dot size of each dot is the same (fixed dot size). Also, the same definitions will also be used for the print area ratio $S_o1$, which is the value indicative of density of dot (dot density), and the black dot area ratio $S_k1$, which only takes into account black dots. As such, the specific examples of the print area ratio $S_o1$ are as shown in FIG. 4 through FIG. 7.

Black Dot Area Ratio and Drying Speed

In the present embodiment, the black ink used to form black dots is a pigment ink. The pigment ink used herein is the slow-drying ink which has high color reproducibility but longer drying time compared with color inks of C, M, Y (dye ink (fast-drying ink)). Thus, when the slow-drying black ink is used to improve image quality, the drying time of the ink becomes longer in an area of high black dot density, i.e., an area where the black dot area ratio $S_k1$ is high.

Further, the black ink of the present embodiment can also be described by the explanation of the -Black Dot Area Ratio and Drying Time- in the First Embodiment-.

Print Data

The following will explain print data for forming an image from dots.

Figure 26:
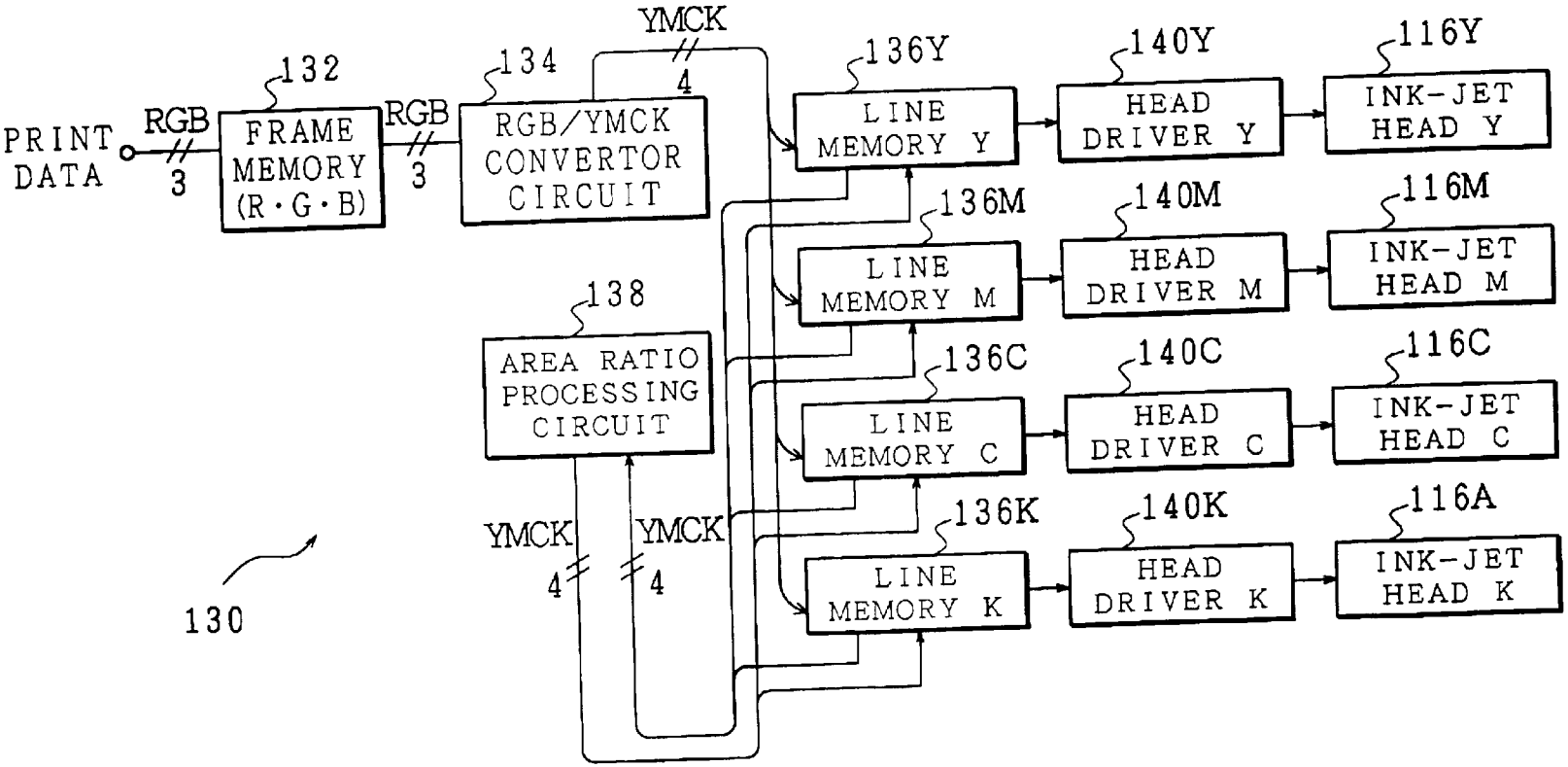
FIG. 26 is a block diagram showing a data processing circuit in accordance with the Third Embodiment of the present invention.

First, a flow of print data is explained based on FIG. 26. FIG. 26 is a block diagram showing a data processing circuit 130 of the print data. The data processing circuit 130 is provided, for example, in the control device 105. As in FIG. 10, R, G, B and Y, M, C, K in FIG. 26 indicate print data (color data) of red, green, blue, and yellow, magenta, cyan, and black, respectively. Also, in the lines connecting blocks, the numbers such as "3" and "4" together with the symbol "//" indicate the number of data of the line (the number of data lines).

The print data of RGB are converted to print data of YMCK in an RGB/YMCK convertor circuit 134 via a frame memory 132. The converted color data (image data) are then inputted to their respective line memories 136Y, 136M, 136C, and 136K. Note that, when the original print data is the print data of YMCK, the RGB/YMCK convertor circuit 134 is not necessary.

The respective color data inputted to the line memories 136Y, 136M, 136C, and 136K are successively sent to an area ratio processing circuit 138, and print area ratio $S_o1$ and black dot area ratio $S_k1$ are calculated.

The data of respective colors thus suitably converted are inputted again into their respective line memories 136Y, 136M, 136C, and 136K. The data of respective colors thus inputted again to the line memories 136Y, 136M, 136C, and 136K from the area ratio processing circuit 138 are inputted to their corresponding head drivers 140Y, 140M, 140C, and 140K. The head drivers 140Y, 140M, 140C, and 140K drive their corresponding yellow head 116Y, magenta head 116M, cyan head 116C, and black head 116A (see FIG. 25) based on the respective inputted print data. Dots are formed on the recording sheet P by the yellow head 116Y, magenta head 116M, cyan head 116C, and black head 116A.

Memory (Line Memory) Structure

The line memories 136Y, 136M, 136C, and 136K have the same structure and function as the line memories 36Y, 36M, 36C, and 36K of the First Embodiment (see FIG. 13). That is, the structures of the line memories 136Y, 136M, 136C, and 136K are as shown in FIG. 13. Note that, the row and column directions of the print data area 50 correspond to a main scanning direction (head moving direction, direction B in FIG. 25) and a sub scanning direction (sheet transport direction, direction A in FIG. 25), respectively, of the ink head 116.

Principles of Invention of the Present Embodiment

The following will describe principles of the invention in accordance with the present embodiment. The invention in accordance with the present embodiment is adapted to adjust proportions of fast-drying ink (dye ink) and slow-drying ink (pigment ink) to prevent contamination of recording sheets P due to undried ink when the recording sheets P come into contact with each other when an image is successively formed on the recording sheets P which are being fed one after another. That is, the proportions of the fast-drying ink and the slow-drying ink are adjusted when forming an image on the recording sheet P so that the ink on the recording sheet P which was fed previously is completely dry by the time the subsequent recording sheet P is fed.

The following describes this principle in more detail. Note that, Tables 7 to 10 and FIG. 27 to 30 show data when an image was formed with respect to a substantially entire surface of the recording sheet P with the monochromatic color of black.

Table 7 shows the time required for printing a single recording sheet P ("print time" hereinafter) in each print mode for different black dot area ratio $S_k1$.

TABLE 7

| BLACK DOT AREA RATIO (%) | Print Time per Sheet (sec.) | | |
|---|---|---|---|
| | NORMAL PRINT | GOOD PRINT | BEST PRINT |
| 100 | 9.0 | 17.6 | 34.7 |
| 90 | 8.2 | 16.0 | 31.4 |
| 80 | 7.4 | 14.3 | 28.1 |
| 70 | 6.4 | 12.4 | 24.2 |
| 60 | 5.6 | 10.7 | 20.9 |
| 50 | 4.8 | 9.0 | 17.6 |
| 40 | 3.9 | 7.4 | 14.3 |
| 30 | 3.1 | 5.7 | 11.0 |
| 20 | 2.1 | 3.8 | 7.1 |
| 10 | 1.3 | 2.1 | 3.8 |

Figure 27:
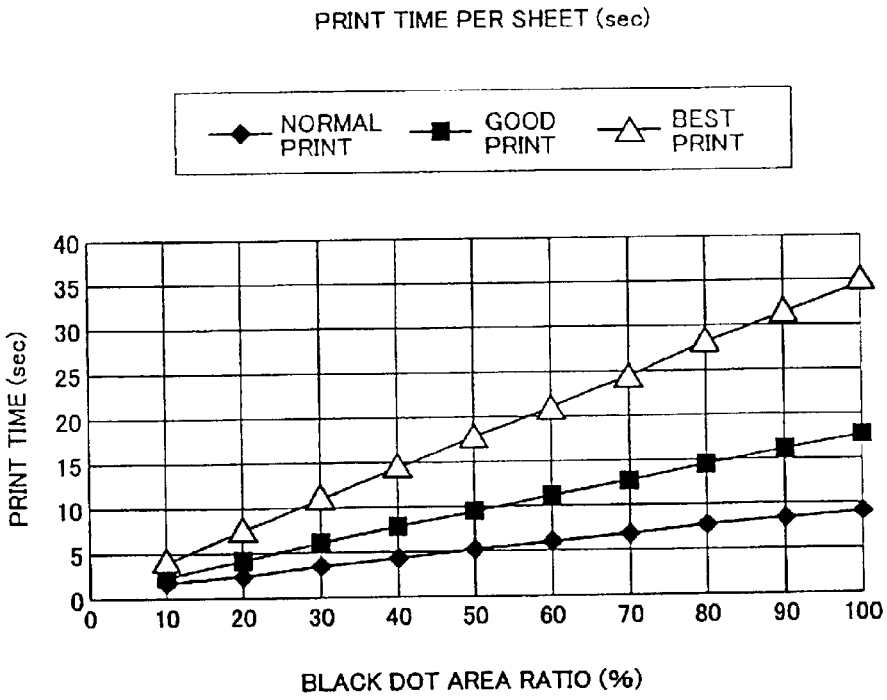
FIG. 27 is a drawing showing a relationship between black dot area ratio and print time in each print mode.

The print mode includes "normal print mode" in which a print speed has the priority, "best print mode" in which image quality has the priority, and "good print mode" which is intermediary of the two modes. FIG. 27 shows a graph of these data. As shown in Table 7 and FIG. 27, a longer print time is required in print modes with higher priority to image quality, and the print time also becomes longer with increase in black dot area ratio $S_K$1. (larger print volume).

Table 8 shows the number of prints made per unit time (1 minute) in each print mode for different black dot area ratio $S_k1$.

TABLE 8

| BLACK DOT AREA RATIO (%) | The Number of Prints (sheets/minute) NORMAL PRINT | GOOD PRINT | BEST PRINT |
|---|---|---|---|
| 100 | 6.7 | 3.4 | 1.7 |
| 90 | 7.3 | 3.8 | 1.9 |
| 80 | 8.1 | 4.2 | 2.1 |
| 70 | 9.4 | 4.8 | 2.5 |
| 60 | 10.7 | 5.6 | 2.9 |
| 50 | 12.5 | 6.7 | 3.4 |
| 40 | 15.4 | 8.1 | 4.2 |
| 30 | 19.4 | 10.5 | 5.5 |
| 20 | 28.6 | 15.8 | 8.5 |
| 10 | 46.2 | 28.6 | 15.8 |

Figure 28:
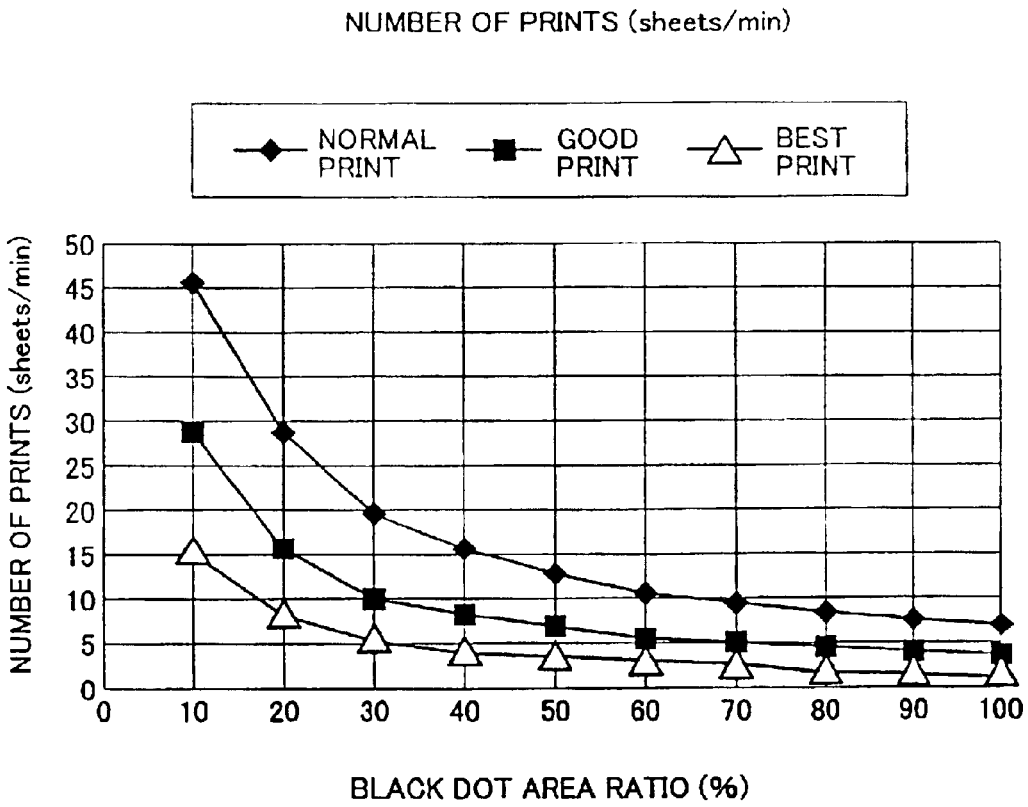
FIG. 28 is a drawing showing a relationship between black dot area ratio and the number of prints per unit time in each print mode.

FIG. 28 is a graph of these data. As shown in Table 8 and FIG. 28, the number of prints made per unit time is decreased as the print mode has higher priority to image quality, and less prints are made with increase in black dot area ratio $S_k1$ (larger print volume.

Table 9 is a table which incorporated a drying (permeation) time of the ink (time required for the ink to completely dry) in Table 7.

TABLE 9

| BLACK DOT AREA RATIO (%) | Print Time per Sheet (sec.) NORMAL PRINT | GOOD PRINT | BEST PRINT | DRYING (PERMEATION) TIME |
|---|---|---|---|---|
| 100 | 9.0 | 17.6 | 34.7 | 15.0 |
| 90 | 8.2 | 16.0 | 31.4 | 12.7 |
| 80 | 7.4 | 14.3 | 28.1 | 10.5 |
| 70 | 6.4 | 12.4 | 24.2 | 8.2 |
| 60 | 5.6 | 10.7 | 20.9 | 6.0 |
| 50 | 4.8 | 9.0 | 17.6 | 3.7 |
| 40 | 3.9 | 7.4 | 14.3 | 1.5 |
| 30 | 3.1 | 5.7 | 11.0 | |
| 20 | 2.1 | 3.8 | 7.1 | |
| 10 | 1.3 | 2.1 | 3.8 | |

Figure 29:
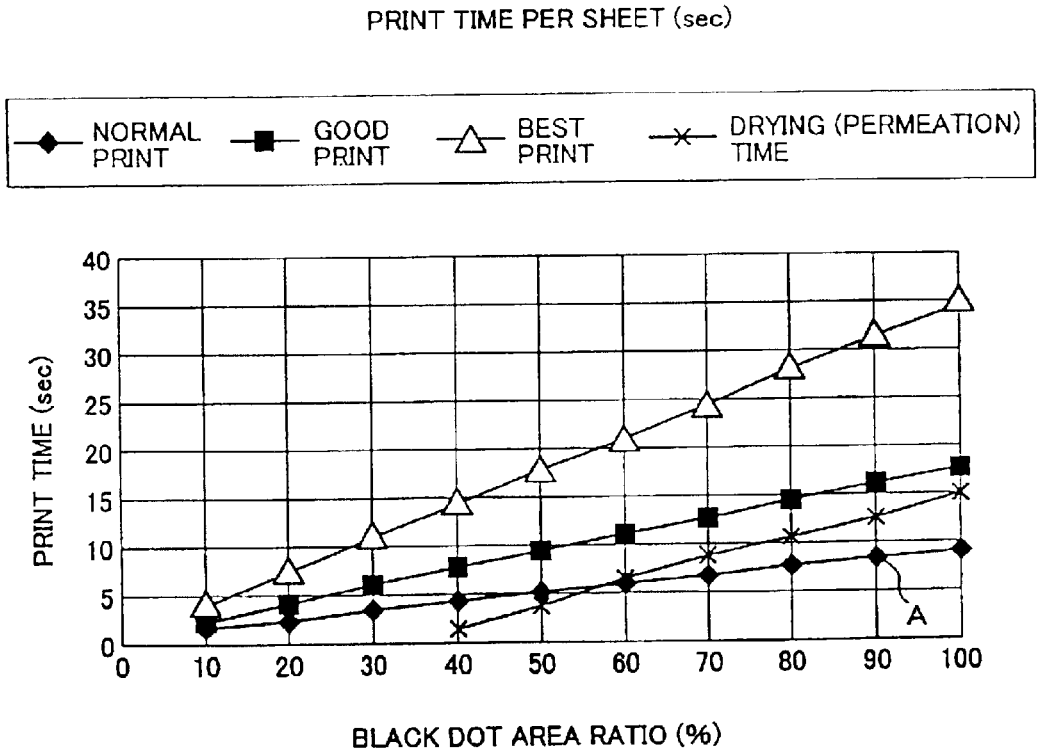
FIG. 29 is a drawing which has incorporated a drying time in FIG. 27.

FIG. 29 is a graph of these data. In FIG. 29, in an area below the line of the drying (permeation) time, the print time becomes shorter than the drying time, and the next (subsequent) recording sheet P is discharged on the discharge tray 104 while the ink on the recording sheet P which was discharged on the discharge tray 104 has not been dried yet. For example, image formation under the print condition of 90% black dot area ratio $S_k1$ in the normal print mode is indicated by point A in FIG. 29, which is below the line of the drying time. Under this condition, the next recording sheet P is discharged while the ink on the previous recording sheet P on the discharge tray 104 has not been dried yet, and as a result the recording sheets P are contaminated as they come into contact with each other on the discharge tray 104. Namely, in Table 9, while the print time under the foregoing print condition is 8.2 seconds, the drying time is 12.7 seconds. That is, the next recording sheet P is discharged before the elapsed drying time of 12.7 seconds, and as a result the recording sheets P are contaminated as they come into contact with each other.

Table 10 is a table which incorporated the number of prints (number of printable sheets) per unit time (1 minute) in Table 8.

TABLE 10

| BLACK DOT AREA RATIO (%) | The Number of Prints (sheets/minute) NORMAL PRINT | GOOD PRINT | BEST PRINT | NUMBER OF PRINTABLE SHEETS |
|---|---|---|---|---|
| 100 | 6.7 | 3.4 | 1.7 | 4.0 |
| 90 | 7.3 | 3.8 | 1.9 | 4.7 |
| 80 | 8.1 | 4.2 | 2.1 | 5.7 |
| 70 | 9.4 | 4.8 | 2.5 | 7.3 |
| 60 | 10.7 | 5.6 | 2.9 | 10.1 |
| 50 | 12.5 | 6.7 | 3.4 | 16.2 |
| 40 | 15.4 | 8.1 | 4.2 | 41.4 |
| 30 | 19.4 | 10.5 | 5.5 | |
| 20 | 28.6 | 15.8 | 8.5 | |
| 10 | 46.2 | 28.6 | 15.8 | |

Figure 30:
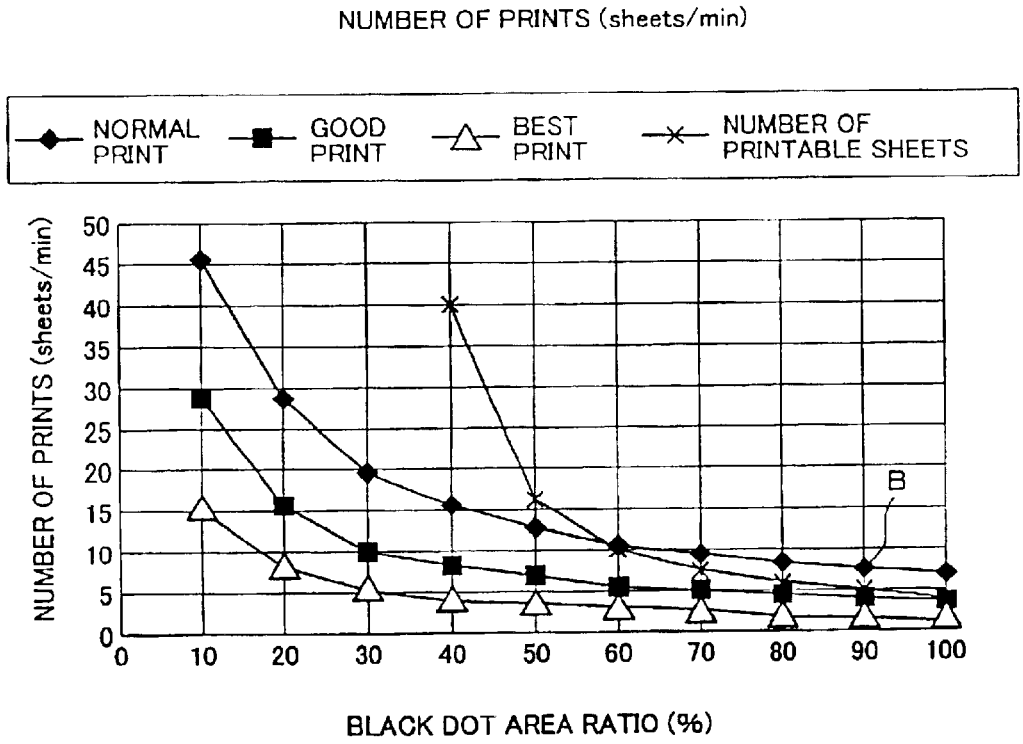
FIG. 30 is a drawing which has incorporated the number of printable sheets in FIG. 28.

FIG. 30 is a graph of these data. In FIG. 30, in an area above the line of number of printable sheets, the next recording sheet P is discharged on the discharge tray 104 while the ink on the recording sheet P which was previously discharged on the discharge tray 104 has not been dried yet. For example, image formation under the print condition of 90% black dot area ratio $S_k1$ in the normal print mode is indicated by point B in FIG. 30, which is above the line of the number of printable sheets. Under this condition, the print time of the ink on the recording sheet P is insufficient with respect to the number of prints, and as a result the recording sheets P are contaminated as they come into contact with each other on the discharge tray 104.

In order to prevent the problem of contamination without increasing the time required for printing (without decreasing the number of prints per unit time), drying time needs to be shortened. The invention in accordance with the present embodiment employs the fast-drying ink (color ink) as means to shorten the drying time. Further, the invention of the present embodiment adjusts the proportions of the fast-drying ink and the slow-drying ink, considering the fact that the time from the application of the ink on a preceding recording sheet P to the discharge of the subsequent recording sheet P is different for each image forming area of the preceding recording sheet P.

Figure 31:
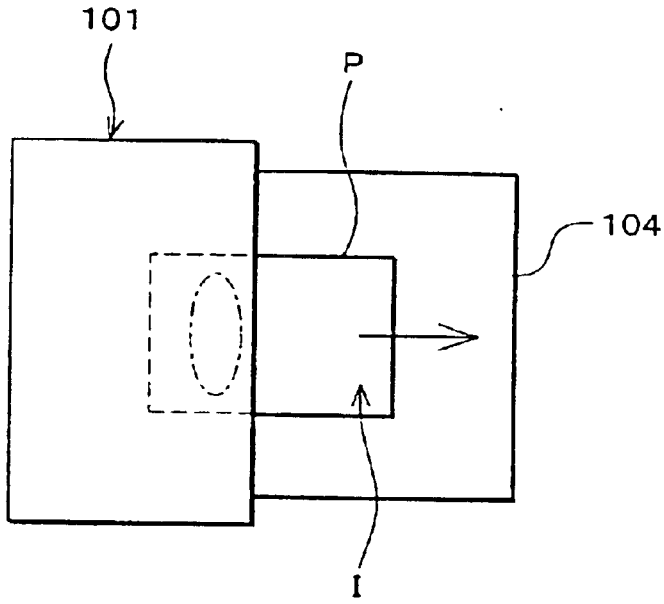
FIG. 31(*a*) and FIG. 31(*b*) are plan views of the color ink-jet printer of FIG. 23, in which FIG. 31(*a*) shows a state where an image is being formed on the recording sheet, and FIG. 31(*b*) shows a state where the image has been formed on the recording sheet.
Figure 31:
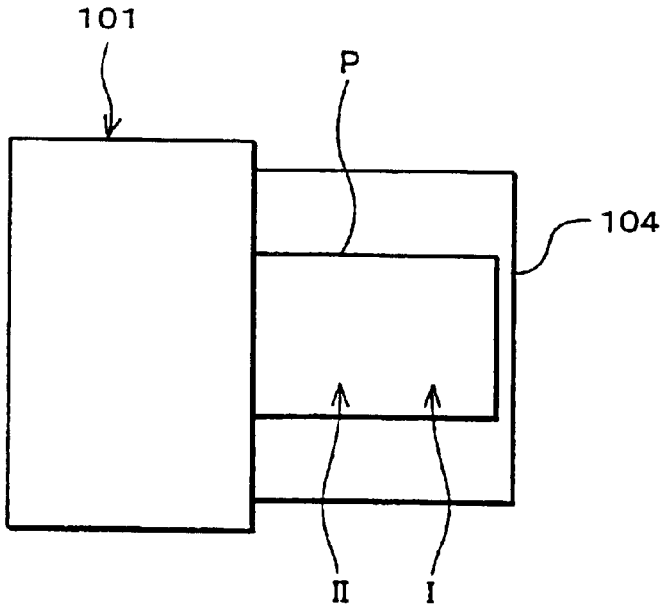

The following explains in detail how the time from the application of the ink on the preceding recording sheet P to the discharge of the subsequent recording sheet P is different for each image forming area of the preceding recording sheet P. FIG. 31(*a*) and FIG. 31(*b*) are plan views of the color ink-jet printer 101, in which FIG. 31(*a*) shows a state in which an image is being formed on the recording sheet P (arrow indicates discharge direction of the recording sheet P), and FIG. 31(*b*) shows a state after the image has been formed on the recording sheet P and the recording sheet P was discharged on the discharge tray 104.

First, considering an image forming operation on the recording sheet P as shown in FIG. 31(*a*), an image has already been formed on a portion of the recording sheet P toward the front end (right side in FIG. 31) thereof relative to a portion where the image is being formed (portion circled by the alternate long and short line in FIG. 31(*a*)), and the ink on this front end portion has been drying already. In particular, the ink on a front end area I of the recording sheet P is exposed to external air longer than the ink on the other area, i.e., a rest time which contributes to drying is longer.

Then, as shown in FIG. 31(*b*), at the moment where the image has been formed and the recording sheet P was discharged on the discharge tray 104, while virtually no rest time has been obtained in a rear end area II of the recording sheet P, the front end area I of the recording sheet P has the rest time which substantially equals to the time which was required to form the image on the recording sheet P (time from the start to the end of image formation). For example, when the dot area ratio $S_k1$ is 100% (print area ratio $S_o1$ is also 100% ) in the normal print mode, the time (print time) required to form an image is 9.0 seconds in Table 9. That is, the front end area I has had the rest time of 9.0 seconds.

Thus, the recording sheet P has different rest times depending on an area of the sheet. That is, the rest time becomes shorter from one end of the recording sheet P where the image formation is started (right side in FIG. 31(*a*) and FIG. 31(*b*)) to the other end of the recording sheet P where the image formation is finished (left side of FIG. 31(*a*) and FIG. 31(*b*)). The present invention takes into consideration this fact and adjusts a ratio of the fast-drying ink to the slow-drying ink for each area of the sheet.

Figure 32:
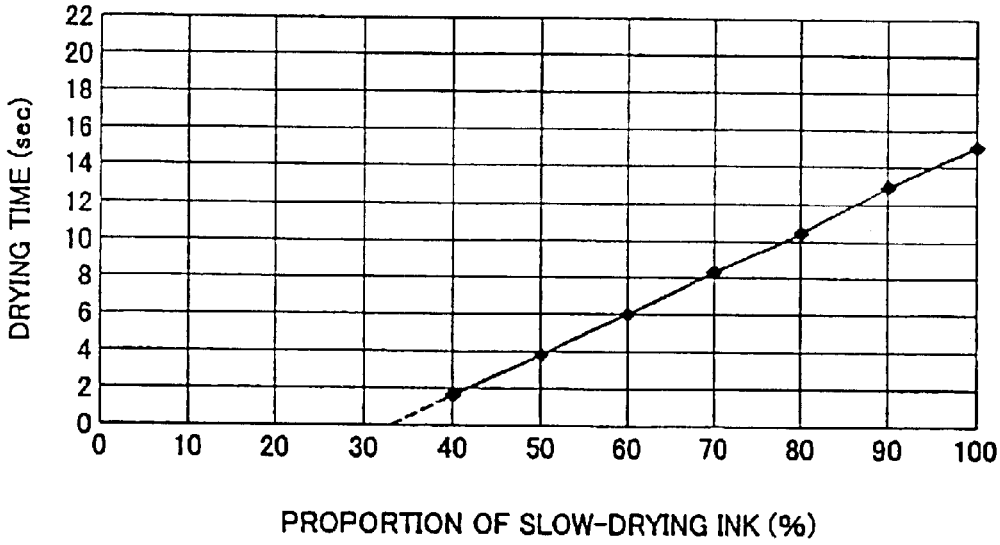
FIG. 32 is a graph showing a relationship between a proportion of the slow-drying ink with respect to a total of the inks used and drying time when the black dot area ratio is 100%.

The following explains a relationship between a ratio of the slow-drying ink with respect to a total of the inks used and the drying time of the inks (time for the inks to completely dry). FIG. 32 is a graph showing a relationship between a proportion of the slow-drying ink with respect to a total of the inks used and the drying time, when the black dot area ratio $S_k1$ is 100% For example, when the proportion of the slow-drying ink with respect to a total of the inks used is 100% (when no fast-drying ink is used), the drying time is about 15 seconds, whereas the drying time is shortened to about 4 seconds when the proportion of the slow-drying ink is 50% .

Figure 33:
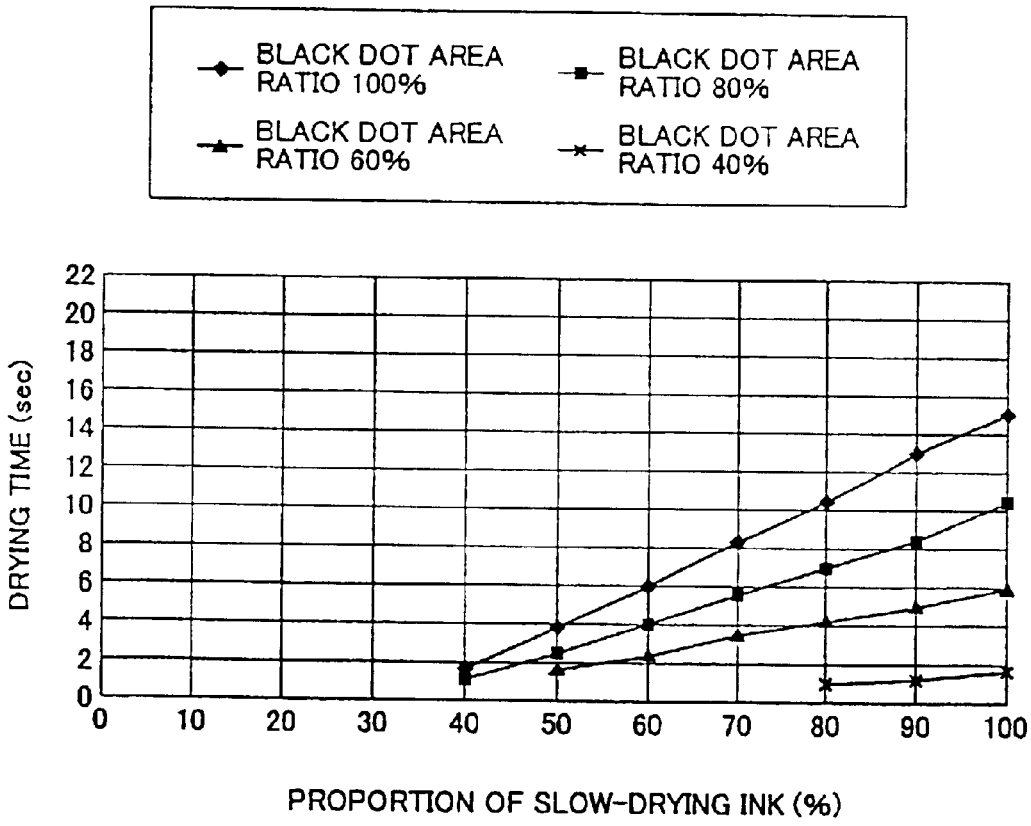
FIG. 33 is a graph showing a relationship between a proportion of the slow-drying ink with respect to a total of the inks used and drying time when the black dot area ratio is varied.

FIG. 33 is a graph showing a relationship between a proportion of the slow-drying ink with respect to a total of the inks used and the drying time when the black dot area ratio $S_k1$ is varied. As can be seen from this graph, the drying time becomes shorter as the proportion of the slow-drying ink is decreased, and also a shorter drying time is obtained with lower black dot area ratio $S_k1$.

Under this principle, the present embodiment adjusts the proportion of the slow-drying ink with respect to a total of the inks used at the time of forming an image on a preceding recording sheet P so that the subsequent recording sheet P is discharged under the condition where the ink on the preceding recording sheet P discharged on the discharge tray 104 has been completely dried.

To this end, the control means (control device) 105 includes rest time recognizing means (rest time recognizing section) 155 and ink ratio adjusting means (ink ratio adjusting section) 15G (see FIG. 24). The rest time recognizing means 155 recognizes the rest time of an ink, from the time the ink was applied to a preceding recording sheet P which is discharged first to the time the subsequent recording sheet P is stacked thereon, with respect to each of the plurality of image forming areas of the preceding sheet P. The ink ratio adjusting means 156 controls, upon receiving an output of the rest time recognizing means 155, a drying time by adjusting, for each image forming area, an area ratio of the slow-drying ink with respect to a total of the inks used, so that the rest time of the ink is not less than the drying time required to dry the inks applied to each image forming area.

Specifically, the ink is introduced by first introducing the slow-drying ink and then the fast-drying ink on the same dot. That is, the black ink (slow-drying ink) is introduced after and over the color ink (fast-drying ink) which was introduced first, with respect to a portion where a black dot is to be formed. In this manner, the color ink is also introduced to an area which is normally intended for only the black ink to form an image, so as to adjust an area ratio of the slow-drying ink with respect to a total of the inks used on the sheet.

Specific Examples of Adjusting Ink Ratio

The following explains specific examples of adjusting an ink ratio when forming an image on the recording sheets P based on the foregoing principle.

First Specific Example

Figure 34:
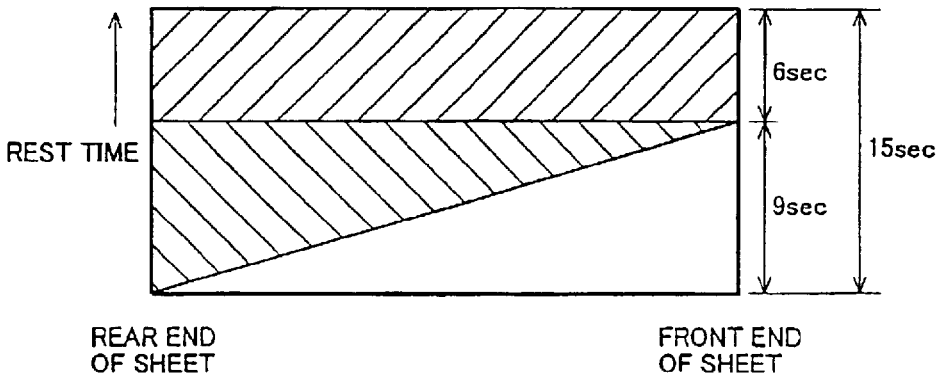
FIG. 34 is a drawing explaining a rest time in each area of the recording sheet, as a first specific example.

First, a first specific example will be explained. FIG. 34 represents coordinates wherein the horizontal axis indicates respective points in the transport direction on the recording sheet P, and the right side and left side of the recording sheet P in FIG. 34 are the front end (where an image is formed first) and the rear end (where the image is formed last), respectively, of the recording sheet P, and the vertical axis indicates the rest time (time which contributes to drying of an ink). Further, the blank area in FIG. 34 indicates the rest time in each area of the recording sheet P, and the area indicated by the oblique lines indicates deficient drying time (time further required to completely dry the ink) when the proportion of the slow-drying ink with respect to a total of the inks used is 100%. Also, FIG. 34 shows the case where the black dot area ratio $S_k1$ in the normal print mode is 100% (print area ratio $S_o1$ is also 100%).

As described, under these print conditions, the front end area of the recording sheet P has the rest time of 9.0 seconds when the image formation on the recording sheet P is finished. In contrast, the rear end area of the recording sheet P has essentially no rest time (the rest time is recognized by the rest time recognizing means 155 in both cases).

However, when the foregoing image formation is operated only with the slow-drying ink (proportion of the slow-drying ink with respect to a total of the inks used is 100%), it will take 15.0 seconds to dry the ink. In this case, the drying time will be deficient for 6.0 seconds even in the front end area of the recording sheet P, and the ink in the rear end area of the recording sheet P will not be dried at all, i.e., it takes 15.0 seconds to dry the ink from the time the image formation on the recording sheet P was finished.

Front End Area of Recording Sheet P

The following considers the front end area of the recording sheet P. The ink in the front end area can be completely dried at the time when the image formation on the recording sheet P is finished, if the ink in this area of the recording sheet P is dried in 9.0 seconds. That is, in the front end area of the recording sheet P, the proportion of the slow-drying ink with respect to a total of the inks used is adjusted so that the ink therein dries in 9.0 seconds. Specifically, referring to FIG. 32, the proportion of the slow-drying ink with respect to a total of the inks used is adjusted at 73% so as to dry the ink in 9.0 sec (by the adjusting operation of the ink ratio adjusting means 156). That is, by adjusting the proportion of the slow-drying ink with respect to the fast-drying ink at 73% in the front end area of the recording sheet P, the ink in this area of the recording sheet P can be dried completely at the time when the image formation on the recording sheet P is finished. Further, without limiting to the proportion of 73%, by having values at or below 73%, the ink in the front end area of a preceding recording sheet P can be dried by the time the subsequent recording sheet P is discharged.

Further, when the black dot area ratio is 80% referring to FIG. 33, in order to dry the ink in 9.0 seconds, the proportion of the slow-drying ink with respect to a total of the inks used is set at or below 92%.

Other Area of the Recording Sheet P

The following will consider the other area of the recording sheet P (area other than the front end area). In this area, the rest time is shorter than 9.0 seconds. That is, as shown in FIG. 34, the rest time becomes shorter proportionally from the front end area to the rear end area. The rest time is 0 second in the rear end area of the recording sheet P. Thus, there will be no contamination due to discharge of a subsequent recording sheet P if the rear end area of the recording sheet P is dried essentially at the same time as the discharge of the recording sheet P. That is, in the rear end area of the recording sheet P, the proportion of the slow-drying ink with respect to a total of the inks used is adjusted so as to dry the ink even when there is essentially no rest time. Specifically, referring to FIG. 32, the ink in the rear end area of the recording sheet P is completely dried at the time when the image formation on the recording sheet P is finished by setting the proportion of the slow-drying ink with respect to a total of the inks used at around 30% . Further, as with the foregoing case, without limiting to 30%, the proportion can also be set at an arbitrary value at or below 30%.

As described, the proportion of the slow-drying ink with respect to a total of the inks used, is set at 73% and 30% in the front end area and rear end area, respectively, of the recording sheet P, and the proportion of the slow-drying ink is adjusted proportionally between these two set values in an intermediate area of the two areas. For example, the proportion of the slow-drying ink is set at around 52% in the middle of the recording sheet P. As a result, the ink is completely dried over the entire area of the recording sheet P at the time when the image formation on the recording sheet P is finished, and there will be no contamination due to contact of the recording sheets P even when the subsequent recording sheet P is discharged immediately after the discharge of the preceding recording sheet P. In particular, by setting the ink proportion at the foregoing values, the proportion of the slow-drying ink can be made as large as possible while ensuring that the subsequent recording sheet P is discharged after the ink on the preceding recording sheet P which was discharged previously is completely dried. The slow-drying ink has superior reproducibility of color compared with the fast-drying ink. That is, contamination of the recording sheets P can be prevented and the color reproducibility can be ensured at the same time.

Here, the ink is introduced by introducing the slow-drying ink immediately after the fast-drying ink on the same dot. By thus introducing the fast-drying ink first, the permeability of the slow-drying ink in the recording sheet P is improved, thus reducing the drying time of the ink forming dots. Here, the fast-drying ink which is introduced first may be any of the inks of C, M, Y, but it is preferable to select an ink, taking into consideration reproducibility of black when the slow-drying ink is introduced.

Second Specific Example

The following will explain a second specific example. In actual image forming operation of the color ink-jet printer 101, it is rare to see that a subsequent recording sheet P is stacked on the preceding recording sheet P immediately after an image has been formed on the preceding recording sheet P. That is, the image forming operation on the subsequent recording sheet P is started after the preceding recording sheet P was discharged on the discharge tray 104, and the subsequent recording sheet P is stacked on the preceding recording sheet P while the image forming operation has proceeded to some extent.

Figure 35:
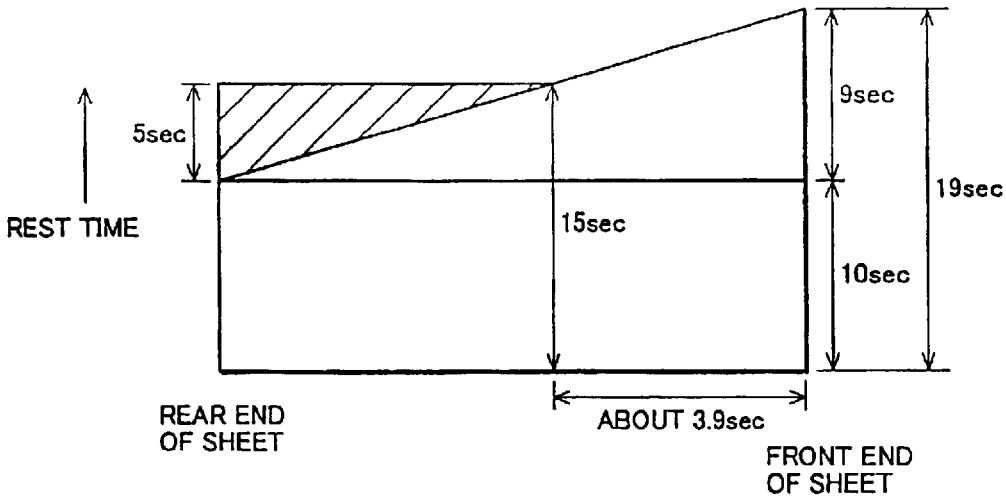
FIG. 35 is a drawing explaining a rest time in each area of the recording sheet, as a second specific example.

The following describes the case where the proportion of the slow-drying ink with respect to a total of the inks used is adjusted when the time from the start of the image forming operation on the subsequent recording sheet P to the time the subsequent recording sheet P is stacked on the preceding recording sheet P is 10 seconds, with reference to FIG. 35. Note that, the following explanation is also based on the case where the black dot area ratio $S_k1$ in the normal print mode is 100% .

As shown in FIG. 35, it takes 10 seconds to stack the subsequent recording sheet P, and thus by the time the subsequent recording sheet P is discharged and stacked, the front end area of the recording sheet P has had the rest time of 19.0 seconds (9 seconds+10 seconds). On the other hand, the rear end area of the recording sheet P has the react time of 10.0 seconds. Thus, the front end area of the recording sheet P has the rest time which is longer than the time (15 seconds) which would have been required if the image forming operation was carried out only with the slow-drying ink (100% proportion of the slow-drying ink with respect to a total of the inks used). Thus, the ink in the front end area has been completely dried, without requiring the fast-drying ink, by the time the image forming operation on the subsequent recording sheet P is finished.

Meanwhile, since the rear end area of the recording sheet P has the rest time of 10.0 seconds, the rest time will be deficient for 5.0 seconds (portion on the left end of the oblique lines in FIG. 35) with respect to the time (15 seconds) which would have been required to dry the ink if the image forming operation was carried out on the rear end area only with the slow-drying ink. Thus, in the rear end area, the proportion of the slow-drying ink with respect to a total of the inks used is adjusted so that the ink therein dries in 10.0 seconds. Specifically, referring to FIG. 32, the proportion of the slow-drying ink with respect to a total of the inks used is adjusted at 78% to dry the ink in 10.0 seconds. That is, by setting the proportion of the slow-drying ink with respect to a total of the inks used at 78% in the rear end area of the recording sheet P, the ink is completely dried therein at the time when the image forming operation on the recording sheet P is finished. Further, not limiting to 78%, the proportion may be set at an arbitrary value at or below 78%.

The area which needs a shorter drying time by using the fast-drying ink is the area where the rest time is less than 15 seconds (area indicated by oblique lines in FIG. 35). That is, it is required to resort to the foregoing adjusting operation from the point on the recording sheet P which is about 44% down toward the rear end of the recording sheet P from the front end thereof with respect to the entire length of the recording sheet P. This can be quantified from the following equation $$(19\text{ sec.}-15\text{ sec.})/(19\text{ sec.}-10\text{ sec.})=4/9=0.44.$$

Thus, when the print time of the recording sheet P is 9 seconds, the adjusting operation of the ink proportion using the fast-drying ink is started after the elapsed time of about 3.9 seconds (9 seconds×0.44) from the start of the image formation on the recording sheet P, so as to completely dry the ink over the entire area of the recording sheet P at the time when the image formation is finished.

Third Specific Example

The following describes a third specific example. The foregoing examples described the case where the black dot area ratio $S_k1$ was 100%. That is, the foregoing explanations were given through the case where the image was evenly formed over the entire area of the recording sheet P. The following describes an application of the present invention where the print volume is different depending on different areas of the recording sheet P, instead of the black dot area ratio of 100%.

Figure 36:
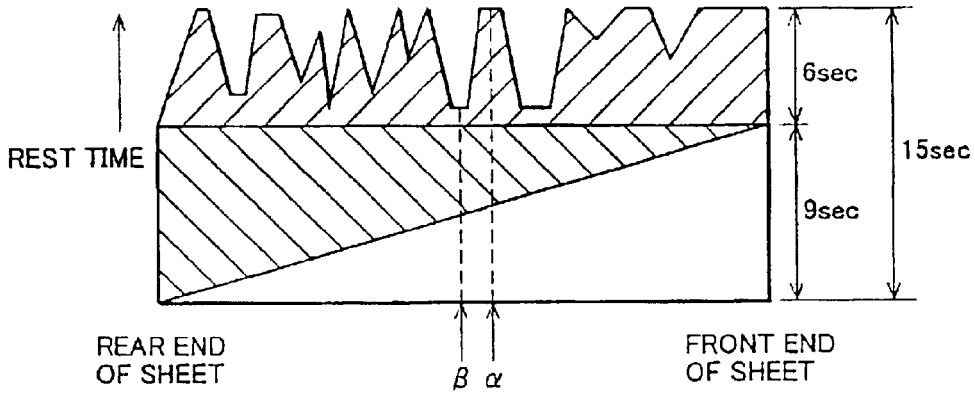
FIG. 36 is a drawing explaining a rest time in each area of the recording sheet, as a third specific example.
Figure 37:
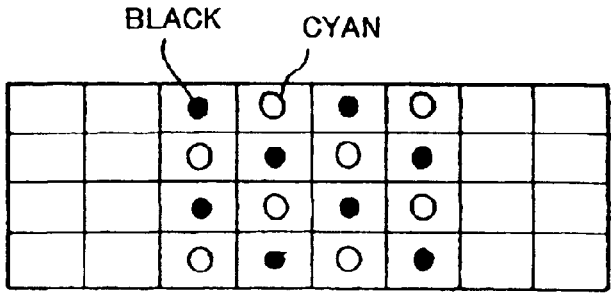
FIG. 37 PRIOR ART
FIG. 37 is a plan view showing an example of how dots were formed conventionally.
Figure 38:
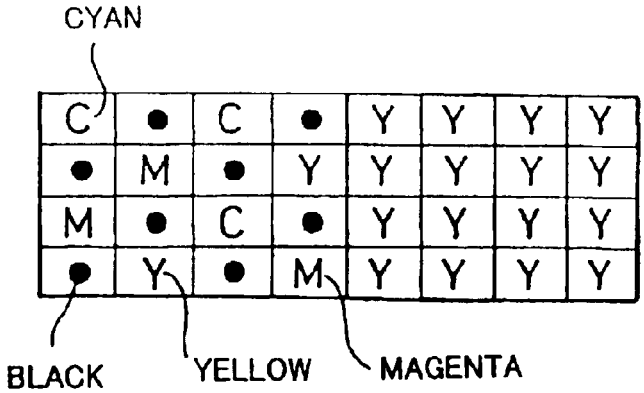
FIG. 38 PRIOR ART
FIG. 38 is a plan view showing another example of how dots were formed conventionally.

As shown in FIG. 36, when the print volume is different in different areas of the recording sheet P (dimension of height of the line drawing (total height of the blank portion and the oblique line portion together) indicates print volume), there will be no proportional change in difference between the time required for drying and the rest time when the image forming operation on each area was carried out only with the slow-drying ink. That is, the dimension of height of an area indicated by the oblique lines in FIG. 36 (time deficient to completely dry the ink) fluctuates over image forming areas.

However, by setting the proportion of the slow-drying ink with respect to a total of the inks used as in the first specific example so that the ink is dried in 9 seconds in the front end area of the recording sheet P, and the ink in the rear end area is dried at the time when the image forming operation on the recording sheet P is finished, irrespective of change in print volume in each area, there will be no contamination due to contact between the recording sheets P.

Incidentally, in order to have high image density, it is preferable to increase the proportion of the slow-drying ink as much as possible. Thus, in the case where the print volume is different in different image forming areas of the recording sheet P, since the drying time will be relatively short in an area where the print volume is small even when the proportion of the slow-drying ink is increased, the proportion of the slow-drying ink with respect to a total of the inks used is adjusted in accordance with this print volume. For example, comparing an area $\alpha$ (where print volume is large) and an area $\beta$ (where print volume is small) adjacent to the area $\alpha$ in the recording sheet P, the ink can be dried more desirably in the area $\beta$ even when the proportion of the slow-drying ink therein is made larger than that in the area $\alpha$ because the area $\beta$ has less print volume, despite the fact that the area $\beta$ is more toward the rear end of the sheet than the area $\alpha$. That is, higher image density can be obtained for the area $\beta$. By thus changing the proportion of the slow-drying ink with respect to a total of the inks used in accordance with the print volume, the ink can be dried over the entire area of the recording sheet P at the time when the image forming operation on the recording sheet P is finished, while increasing the image density as high as possible. Specifically, the ratio of the fast-drying ink to the slow-drying ink is adjusted in accordance with the proportion of the dimension of height of the oblique line portion of FIG. 36. That is, the proportion of the slow-drying ink with respect to a total of the inks used is made smaller (proportion of the fast-drying ink is increased) in an image forming area where the dimension of height of the oblique line portion is large, whereas the proportion of the slow-drying ink with respect to a total of the inks used is made larger (proportion of the fast-drying ink is decreased) in an image forming area where the dimension of height of the oblique line portion is small.

The foregoing operation of the third specific example may be used in combination with the second specific example where it takes a predetermined time from the discharge of the preceding recording sheet P to the time the subsequent recording sheet P is stacked.

Additional Example

In the described embodiments, the ink is introduced such that the slow-drying ink is introduced immediately after the fast-drying ink is introduced on the same dot. The present invention however is not just limited to this, and the respective inks may be introduced to different dots so as to adjust an area ratio of the slow-drying ink with respect to a total of the inks used on the recording sheet P.

Further, the described embodiments used the color inks and the black ink as the fast-drying ink and the slow-drying ink, respectively. However, the present invention is not just limited to this and a black dye ink may also be used as the fast-drying ink in addition to the color inks.

As described, the ink-jet image forming method and the ink-jet image forming device in accordance with the Third Embodiment of the present invention takes into consideration the fact that the drying time becomes different depending on a ratio of the fast-drying ink to the slow-drying ink when these inks are used together, so as to control the time required to dry the ink in each image forming area of a preceding recording sheet which was discharged previously, by adjusting the ratio of the inks so that the subsequent recording sheet is discharged after the ink in each image forming area of the preceding recording sheet is dried. As a result, it is possible to shorten the time required to form an image, and, at the same time, prevent contamination of the recording sheets due to undried ink, without requiring special means to dry the ink.

Specifically, the operation of ratio adjustment may be carried out by gradually reducing by the ink ratio adjusting means the proportion of the slow-drying ink with respect to the fast-drying ink from a starting end to a finishing end of image formation on the recording sheet.

Further, the proportion of the slow-drying ink with respect to the fast-drying ink is changed proportionally from the starting end to the finishing end of image formation on the recording sheet.

That is, at the starting end of image formation on the recording sheet, the drying operation is started during the image forming operation on the recording sheet, and the rest time of the ink is longer in this area of the recording sheet compared with the finishing end of image formation on the recording sheet. Thus, considering that the rest time is different for each image forming area in the transport direction of the recording sheet, the proportion of the inks is changed from the starting end to the finishing end of image formation.

Further, the ink ratio adjusting means is adapted to adjust an area ratio of the fast-drying ink to the slow-drying ink on the recording sheet.

Further, when adjusting the ratio of the fast-drying ink to the slow-drying ink, the fast-drying ink is applied beforehand on a position where the slow-drying ink is applied before the slow-drying ink is applied on the recording sheet.

In this manner, by applying the fast-drying ink first on the recording sheet, the permeability of the slow-drying ink in the recording sheet can be improved and the drying time of the ink for forming dots can be made shorter. This makes it possible to discharge the subsequent recording sheet after the ink on the preceding recording sheet has been dried completely, even when the drying time of the ink on the recording sheet becomes shorter and the duration of image formation becomes short. As a result, the number of recording sheets which can be subjected to image formation per unit time can be increased, thus making the operation of the image forming device faster.

Further, the ratio adjustment of the ink by the ink ratio adjusting means may be optimized by adjusting the ratio of the fast-drying ink to the slow-drying ink for each image forming area so that the required drying time and the rest time of the ink coincide.

In this way, the proportion of the slow-drying ink can be increased as much as possible while ensuring that the subsequent recording sheet is discharged after the ink on the preceding recording sheet which was discharged previously is completely dried. The slow-drying ink has superior reproducibility of color than the fast-drying ink. Thus, in the foregoing manner, contamination of recording sheets can be prevented and reproducibility of color can be ensured at the same time.

Specifically, the rest time recognizing means may operate to calculate the rest time of the ink based on the volume of image formation with respect to a subsequent recording sheet. As a result, the rest time of the ink can be obtained more accurately, and the required drying time can be controlled more suitably.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An ink-jet image forming method which is adapted to use a fast-drying ink together with a slow-drying ink, and which successively forms images with the fast-drying ink and the slow-drying ink on a plurality of recording sheets which are successively fed, and discharges the recording sheets so that a subsequent recording sheet is stacked on preceding recording sheet, wherein:

a drying time which is required to dry an ink applied to each of a plurality of image forming areas on the preceding recording sheet is controlled by adjusting, with respect to each image forming area, a ratio of the fast-drying ink to the slow-drying ink which are used to form an image, so that a rest time of the ink, which is a time period from an application of the ink to a time the subsequent recording sheet is stacked, is equal to or greater than the drying time with respect to each image forming area of the preceding recording sheet, and wherein the drying time is controlled by adjusting independently, with respect to each image forming area a ratio of the fast-drying ink to the slow-drying ink which are used to form an image.

2. The ink-jet image forming method as set forth in claim 1, wherein adjusting a ratio of the fast-drying ink to the slow-drying ink includes gradually decreasing a proportion of the slow-drying ink with respect to the fast-drying ink from a starting end to a finishing end of image formation on a recording sheet.

3. An ink-jet image forming device which is adapted to use a fast-drying ink together with a slow-drying ink, and which successively forms images with the fast-drying ink and the slow-drying ink on a plurality of recording sheets which are successively fed, and discharges the recording sheets so that a subsequent recording sheet is stacked on a preceding recording sheet, said ink-jet image forming device comprising:

rest time recognizing means for recognizing a rest time of an ink, which is a time period from an application of the ink to a time the subsequent recording sheet is stacked, with respect to each of a plurality of image forming areas on the preceding recording sheet; and ink ratio adjusting means for controlling, upon receiving an output of said rest time recognizing means, a drying time which is required to dry the ink applied to each of the plurality of image forming areas on the preceding recording sheet, by adjusting, with respect to each image forming area, a ratio of the fast-drying ink to the slow-drying ink which are used to form an image, so that a rest time of the ink is equal to or greater than the drying time with respect to each image forming area of the preceding recording sheet, wherein the drying time is controlled by adjusting independently, with respect to each image forming area, a ratio of the fast-drying ink to the slow-drying ink which are used to form an image.

4. The ink-jet image forming device as set forth in claim 3, wherein said ink ratio adjusting means is adapted to gradually decrease a proportion of the slow-drying ink with respect to the fast-drying ink from a starting end to a finishing end of image formation on a recording sheet.

5. The ink-jet image forming device as set forth in claim 4, wherein the proportion of the slow-drying ink with respect to the fast-drying ink is changed proportionally from the starting end to the finishing end of image formation on the recording sheet.

6. The ink-jet image forming image device as set forth in claim 3, wherein said ink ratio adjusting means is adapted to adjust an area ratio of the fast-drying ink to the slow-drying ink on a recording sheet.

7. The ink-jet image forming device as set forth in claim 3, wherein, when adjusting the ratio of the fast-drying ink to the slow-drying ink, the fast-drying ink is applied in advance to a position where the slow-drying ink is to be applied, before the slow-drying ink is applied on a recording sheet.

8. The ink-jet image forming device a set forth in claim 3, wherein said ink ratio adjusting means is adapted to adjust the ratio of the fast-drying ink to the slow-drying ink with respect to each image forming area so that the drying time and the rest time of the ink coincide.

9. The ink-jet image forming device as set forth in claim 3, wherein said rest time recognizing means is adapted to calculate the rest time of the ink based on a volume of image formation on the subsequent recording sheet.

10. An ink-jet image forming device which is adapted to use a fast-drying ink together with a slow-drying ink, and which successively forms images with the fast-drying ink and the slow-drying ink on a plurality of recording sheets which are successively fed, and discharges the recording sheets so that a subsequent recording sheet is stacked on a preceding recording sheet, said ink-jet image forming device comprising:

a rest time recognizing section for recognizing a rest time of an ink, which is a time period from an application of the ink to a time the subsequent recording sheet is stacked, with respect to each of a plurality of image forming areas on the preceding recording sheet; and an ink ratio adjusting section for controlling, upon receiving an output of said rest time recognizing section, a drying time which is required to dry the ink applied to each of the plurality of image forming areas on the preceding recording sheet, by adjusting, with respect to each image forming area, a ratio of the fast-drying ink to the slow-drying ink which are used to form an image, so that a rest time of the ink is equal to or greater than the drying time with respect to each image forming area of the preceding recording sheet, wherein the drying time is controlled by adjusting independently, with respect to each image forming area, a ratio of the fast-drying ink to the slow-drying ink which are used to form an image.

11. The ink-jet image forming device as set forth in claim 10, wherein the proportion of the slow-drying ink with respect to the fast-drying ink is changed proportionally from the starting end to the finishing end of image formation on the recording sheet.

* * * * *